US007373858B1

(12) United States Patent
Hawkins

(10) Patent No.: US 7,373,858 B1
(45) **Date of Patent: *May 20, 2008**

(54) OPENER FOR PULL TOP-TYPE CANS

(76) Inventor: Kerry L. Hawkins, P.O. Box 1244, Columbia, MO (US) 65205-1244

( * ) Notice: Subject to any disclaimer, the term of this patent is extended or adjusted under 35 U.S.C. 154(b) by 0 days.

This patent is subject to a terminal disclaimer.

(21) Appl. No.: 11/169,379

(22) Filed: Jun. 29, 2005

Related U.S. Application Data

(63) Continuation-in-part of application No. 10/626,136, filed on Jul. 24, 2003, now Pat. No. 6,945,137.

(60) Provisional application No. 60/444,324, filed on Jan. 30, 2003, provisional application No. 60/458,082, filed on Mar. 25, 2003, provisional application No. 60/476,919, filed on Jun. 8, 2003, provisional application No. 60/583,702, filed on Jun. 29, 2004.

(51) Int. Cl.
*B67B 7/16* (2006.01)

(52) U.S. Cl. ..... 81/3.55; 81/3.44; 81/3.47; 81/3.56

(58) Field of Classification Search ..... 81/3.55, 81/3.44, 3.47, 3.56
See application file for complete search history.

(56) References Cited

U.S. PATENT DOCUMENTS 713,403 A * 11/1902 Cooper ..... 7/138
1,329,707 A * 2/1920 Hansen ..... 7/129
1,690,982 A * 11/1928 Kossuth et al. ..... 81/3.44
1,991,307 A * 2/1935 Worden ..... 294/31.1
2,464,646 A * 3/1949 Mitchell ..... 81/3.56
3,290,967 A 12/1966 Stark
3,724,297 A 4/1973 Bucko
3,954,030 A 5/1976 Newton
D240,188 S 6/1976 Lytle
4,167,056 A 9/1979 Nattel
4,207,781 A 6/1980 Greenwood
4,241,626 A 12/1980 Hall
4,287,794 A 9/1981 Kubach et al.
4,362,071 A 12/1982 Coker
4,425,826 A * 1/1984 Morris ..... 81/3.36
4,583,429 A 4/1986 Kroeger et al.
4,723,465 A 2/1988 Hughes
5,018,409 A 5/1991 Bittel
5,095,777 A 3/1992 Osmar et al.
5,222,265 A 6/1993 Hermansson
D339,042 S * 9/1993 Friend ..... D8/42
5,309,794 A 5/1994 Kelly (Continued)

*Primary Examiner*—Joseph J. Hail, III
*Assistant Examiner*—Bryan R Muller
(74) *Attorney, Agent, or Firm*—Polster, Lieder, Woodruff & Lucchesi, L.C.

(57) ABSTRACT

A can opener for a pull top-type can includes a body comprising a forward surface, a rear surface, and a bottom surface. The bottom surface is curved to define a rounded heel. The opener includes a starting notch and a finishing notch. The notches are both located along the front of the opener, and the finishing notch is spaced above the starting notch. The can opener is provided with a retainer to maintain the can lid on the opener after the lid has been removed from the can. The retainer can be a fixed or moveable retainer. The can opener can be provided with a vertically or horizontally cutting can opener mechanism to enable the opener to function as a dual purpose opener.

35 Claims, 11 Drawing Sheets

U.S. PATENT DOCUMENTS 5,555,778 A 9/1996 Otters et al.
5,833,285 A 11/1998 Venezia
5,862,720 A * 1/1999 McNellis ..... 81/3.09
5,913,953 A 6/1999 Eve et al.
6,070,497 A 6/2000 Farelli
6,311,580 B1 11/2001 Nagy
6,354,174 B1 3/2002 Korwin

* cited by examiner

OPENER FOR PULL TOP-TYPE CANS

CROSS-REFERENCE TO RELATED APPLICATIONS

This application is a continuation-in-part of application Ser. No. 10/626,136 filed Jul. 24, 2003 now U.S. Pat. No. 6,945,137 which, in turn, claims priority to Provisional Application Nos. 60/444,324 filed Jan. 30, 2003, 60/458,082 filed Mar. 25, 2003 and 60/476,919 filed Jun. 8, 2003, as well as to Disclosure Document No. 525253 filed Jan. 28, 2003 and Disclosure Document No. 5265528 filed Feb. 15, 2003, all of which are incorporated herein by reference. In addition, this application claims priority to Provisional Application No. 60/583,702 filed Jun. 29, 2004. Additionally, this application claims priority to Document Disclosure No. 541020 filed Oct. 29, 2003, Document Disclosure No. 556100 filed Jun. 28, 2004, and Document Disclosure No. 556099 filed Jun. 28, 2004. Further, this application is related to Provisional Application No. 60/515,226 filed Oct. 29, 2003, Provisional Application No. 60/578,040 filed Jun. 8, 2004, Provisional Application No. 60/581,674 filed Jun. 22, 2004. All the above noted applications and Document Disclosures are incorporated herein by reference. In addition, the Patent Office is requested to maintain in its files copies of the document disclosures referenced herein.

STATEMENT REGARDING FEDERALLY SPONSORED RESEARCH OR DEVELOPMENT

Not Applicable.

BACKGROUND OF THE INVENTION

My invention is related to openers for food and beverage cans, and, in particular, to an opener for opening cans having pull tabs which are used to pry the can lid off the can.

Pull top cans are often used for items such as cat food, dog food, tuna, canned fruit, pudding, and numerous single serving products. As is known, the pull top can includes a pull tab on the can lid. The pull tab enables the can lid to be pried open and lifted off the can, providing access to the contents of the can without the use of a can opener. However, it is often difficult to raise the pull tab off the surface of the lid. Additionally, once the pull tab has been raised to a position where the seal of the can has been broken, it can be difficult to remove the lid from the can. The difficulty in opening such cans is increased for those with long nails, with disabilities, such as arthritis, or otherwise simply lack the strength or coordination to open a pull tab type can.

Various different openers have been provided. However, the currently commercially available openers of which I am aware suffer from several drawbacks. Some are difficult to use and, in fact, do not make opening of the can any easier. Others do not adequately grip the can lid, and the can lid can spring off the opener when the can lid is pried off the can.

BRIEF SUMMARY OF THE INVENTION

Briefly stated, a can opener for a pull top-type can includes a body, preferably at the end of a handle. The body comprises a front surface, a rear surface, and a bottom surface. The bottom surface is curved to define a rounded heel. The heel preferably has a changing radius, with a first radius along a forward portion of the heel and a second radius along the rear portion of the heel; and wherein the forward portion radius is greater than the rear portion radius.

The body also includes a starting notch and a finishing notch spaced vertically above the starting notch. Both the starting and finishing notches are positioned along the front of the body.

The body includes a port which opens into the starting notch. The port includes a flat lower surface which intersects with the body's front surface to define an acute angle. In one variation, the opener includes a second port spaced above the first port and which communicates with the finishing notch. In a second variation, the opener includes a channel which extends upwardly from the starting notch and which communicates with the finishing notch.

In the first variation, the body includes a retainer which extends over the opening into the finishing notch. The retainer can comprise a channel which extends from the finishing notch to the second port or a lip which extends over the retaining notch. If a channel is provided, the channel can be either straight or curved. The channel, in combination with the retaining notch, may define a generally J-shaped retainer. Further, the retainer can comprise a moveable member having an end which closes the opening to the finishing notch. The moveable member can comprise, for example, a pivotable member, an axially sliding member, or a rotating member; and the moveable retaining member can pivot, slide, or rotate either horizontally or vertically (i.e., in the plane of the body or generally transverse to the plane of the body). The moveable member can be a lever positioned on top of the body, or a member received within a chamber in the opener body and which pivots relative to the body between an open and a closed position. No matter which style is used, the moveable retainer can be biased closed by use of a spring element.

The can opener can be provided with a first handle fixed to and extending rearwardly from the opener body and a second movable handle pivotal relative to the body and the first handle. The movable handle has a gripping end and a forward end and is pivotally connected to the opener body or first handle intermediate the ends of the second handle. The finishing notch and an associated lip are positioned on one of the opener body and the second handle forward end and the retainer with its associated lip is positioned on the other of the opener body and the second handle forward end. The second handle is pivotal between a first position in which the retainer lip is proximate the finishing notch lip to place the retainer in a closed position and a second position in which the retainer lip is spaced from the finishing notch lip to place the retainer in an open position. The second handle can pivot in a plane that is either generally parallel to, or generally perpendicular to, the plane of the opener body.

In the second variation, in which the opener includes a single port and a channel extending upwardly from the starting notch, the finishing notch can be located on either a forward or rearward edge of the channel. If the notch is on the forward edge of the channel, the opener can be provided with a rebound slot which extends generally rearwardly from the finishing notch.

The can opener of the present invention can also be paired with a traditional vertically or horizontally cutting can opener (i.e., an opener for a can which does not include a pull tab). In the two handled embodiments, the starting and finishing notches, as noted above, can be associated with the two handles, or both the starting and finishing notch can be part of the opener body, which, is mounted to one of the two handles of the vertical or horizontally cutting can opener.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

Figure 1:
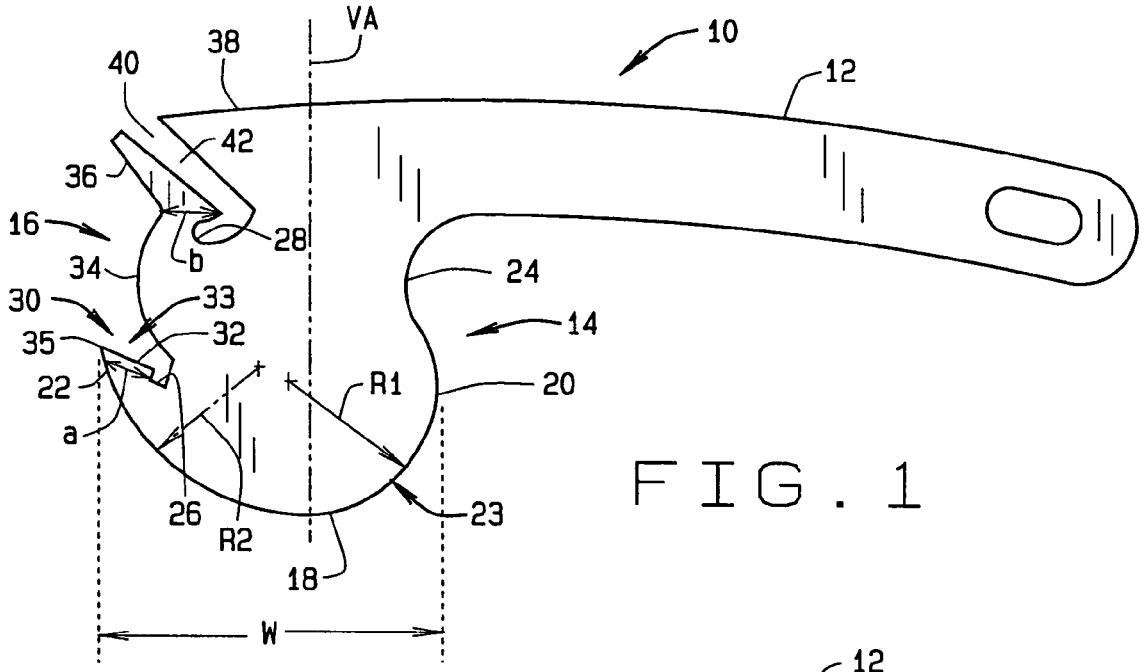
FIG. 1 is a plan view of a first illustrative embodiment of a can opener of the present invention.

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention. Additionally, it is to be understood that the invention is not limited in its application to the details of construction and the arrangements of components set forth in the following description or illustrated in the drawings. The invention is capable of other embodiments and of being practiced or being carried out in other various ways. Also, it is to be understood that the phraseology and terminology used herein is for the purpose of description and should not be regarded as limiting.

Figure 2:
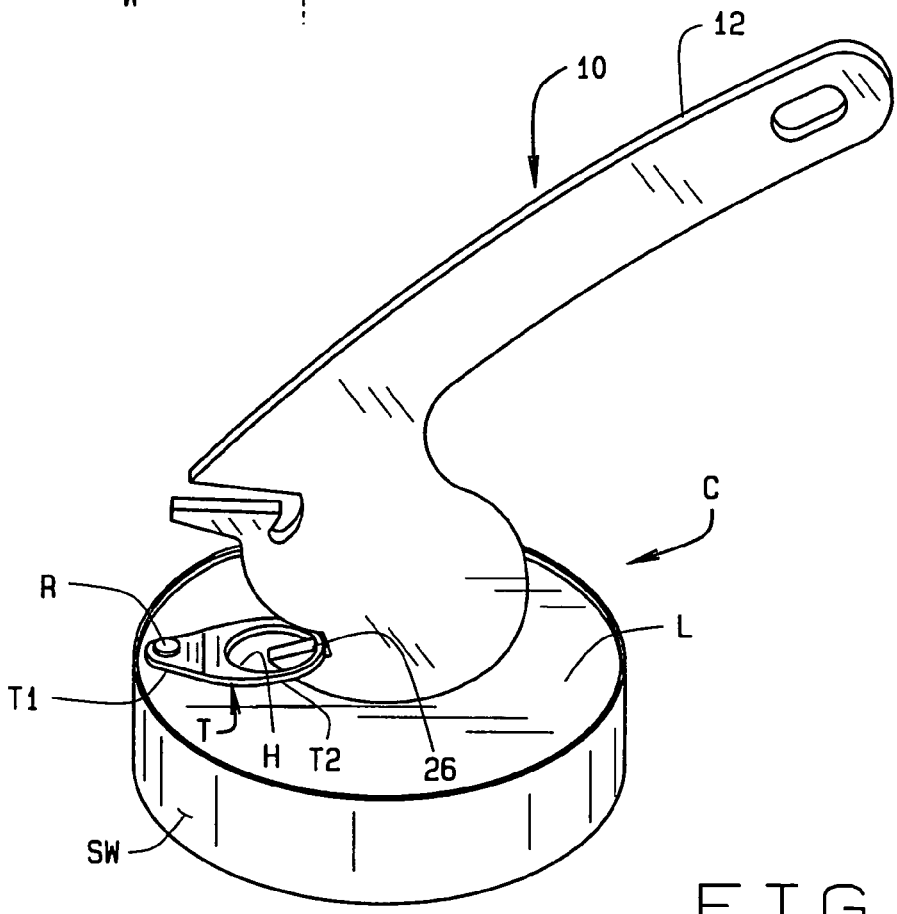
FIG. 2 is a perspective view of the can opener with its starting notch engaging a pull tab of a can.

Referring initially to FIG. 2, a typical pull top-type can C has side walls SW and a lid L. Typically there is a rim extending above the lid defined by the side walls. To enable the can to be opened, and the lid to be removed, without the use of a typical kitchen can opener, the lid is provided with a pull tab T. The pull tab T extends generally radially inwardly from a point near the edge of the lid. The pull tab has a first end T1 that is near the edge of the lid and a second end T2 that is closer to the center of the lid. The pull tab T is secured to the lid by a rivet R near the pull tab first end T1, but spaced radially inwardly slightly from the pull tab first end. A hole H forms a ring at the second end of the tab to allow the tab to be grasped for opening of the can. As is known, to open the can C, the pull tab T is lifted up at its second end until the pull tab first end T1 breaks the seal on the lid. Effectively, by lifting the second end T2, the first end T1 is forced down into the can, and, after a predetermined amount of lifting (based on the dimensions of the pull tab and the position of the rivet), separates the lid from the can wall to break the seal of the can. When the seal is open (typically when the pull tab forms an angle with the lid of between 45° and 90°), the pull tab is pulled rearwardly or radially (i.e., away from the point of rivet). The lid will then separate from the can, and the user will have access to the contents of the can. It is often difficult to lift up the tab in the first instance, and it is also often difficult to perform the second step to complete opening of the can. The difficulty is increased for example, for someone with long finger nails, for someone who is arthritic or for someone who otherwise lacks the strength or coordination necessary to lift and pull the tab T. Additionally, sometimes the lid can "spring" causing a mess in the area where the can is opened. As discussed below, the can opener 10 of the present invention facilitates opening of cans.

A first illustrative embodiment of the opener 10 is shown in FIG. 1. The opener 10 includes a handle 12 and a body 14 at the forward end of the handle. The body 14 includes a front 16, a bottom edge 18, and a back edge 20. The bottom edge 18 and back edge 20 are curved. In fact, the bottom edge 18 curves around to join with a front edge 22. The edges 18, 20, and 22 transition smoothly from the edge 22 to the edge 18 to the edge 20 and define a generally U-shaped heel 23 for the body. The curvature defined by the edges 18, 20, and 22 is a French curve—that is, the radius of the curve changes along the length of the curve. Therefore, as can be seen, the radius of the curve along the front edge 22 is greater than the radius of the curve along the bottom edge 18 and back edge 20. For example, the curvature along the back and bottom edges can have a radius R1 of about 1"-2"; and the curvature of the front edge 22 can have a radius R2 at the upper edge of the front surface 22 of about 3"-6". The back edge 20, as seen, curves inwardly just below the handle, to define a concave portion 24 of the back edge. Further, the opener 10 has a front-to-back width W of about 2½" to about 2¾". These dimensions can be changed as desired to enable the opener to be used with cans of different sizes. Additionally, the shape of the back edge can be altered if desired.

At the front 16, the opener 10 has a first or starting notch 26 and a second or finishing notch 28 which is positioned above the starting notch. A first port 30 opens into the starting notch 26. As seen in FIG. 1, the finishing notch is spaced both vertically and horizontally from the starting notch. If desired, the body 14 could be configured such that the finishing notch is directly above (i.e., not horizontally spaced) from the starting notch. The port 30 is defined by a substantially flat lower surface 32 and a curved forward surface 34. The flat lower surface 32 extends generally perpendicular to the side walls of the notch 26 and generally parallel to the bottom surface the notch 26. As also seen, the surface 32 is sloped relative to a vertical axis VA of the body 14. Hence, the notch 26 also defines an angle with the body vertical axis. The bottom surface of the notch and the port surface 32 both define an angle of about 65° to about 75° with the vertical axis VA.

The port lower surface 32 intersects with the front edge 22, and the front edge 22 and surface 32 define an acute angle. Preferably, the intersection defies a point 35. The area of the body where the port surface 32 and the forward edge 22 intersect defines an anvil 33. The notch 26 is at the back of the surface 32 and drops below the surface 32. The notch 26, as seen in FIG. 1, includes a forward surface, a bottom surface, and a rear surface. The notch bottom surface is spaced below the surface 32, and is shown to be generally parallel to the surface 32. The forward surface of the notch is formed such that there is an abrupt transition between the notch forward surface and the surface 32. Although the notch 26 is shown to have a generally square shape, the notch could have different configurations. For example, the notch could have curved surfaces.

The surface 32 is formed such that there is a length "a" between the notch 26 and the surface 22 which is less than the diameter of the hole H in the can's pull tab T, so that the tab hole H can fit over the lip or anvil 33 and be received in the notch 26. Generally, the smallest pull tab's have holes of about ½". Thus, the length "a" preferably is about 7⁄16" which corresponds to the length of the anvil 33.

A lip 36 extends diagonally upwardly and forwardly from the top of the edge 34. The top surface of the lip 36 is approximately level with, or slightly below, the top edge 38 of body 14. A second port 40 is formed between the lip 36 and the forward end of the body top edge 38, and a channel 42 extends from the port 40 to the finishing notch 28. The channel 42 is shown to be straight and is defined in part by the top surface of the lip 36. The channel 42 slopes downwardly and inwardly, defining an angle of about 45° to about 55° with the body vertical axis VA. The notch 28 curves downwardly and slightly forwardly of the end of the channel 42. The channel is formed such that there is a distance "b" between the rear tip of the lip 36 and the base of the lip 36. This distance "b", like the distance "a", must be less than the diameter of the pull tab hole so that the tab hole can fit over the lip 36 and be received in the notch 28. As with the distance "a", the distance "b" preferably is about 7⁄16" so that the opener will be able to accommodate most size tabs.

Figure 3A:
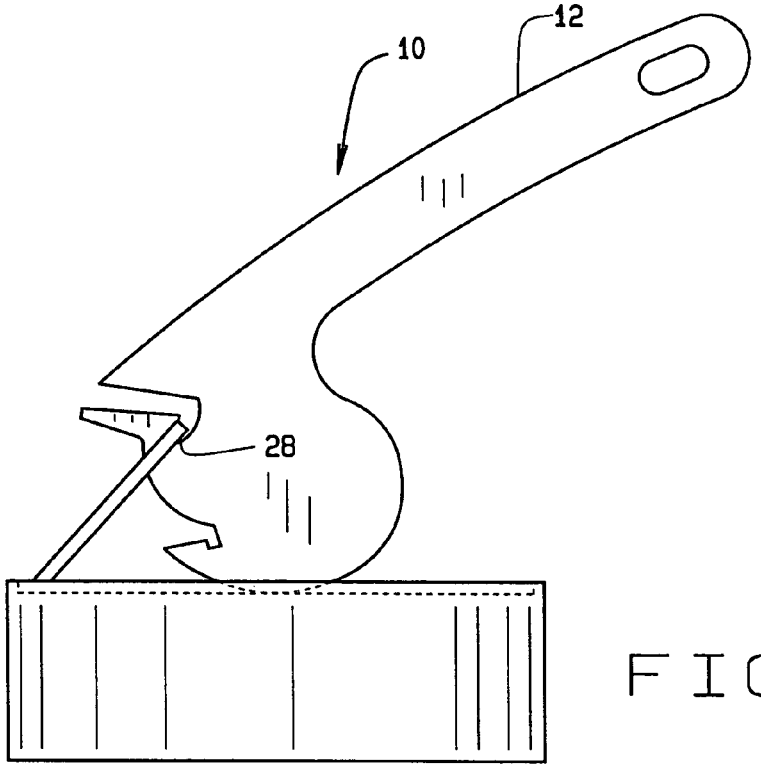
FIG. 3A is a side elevational view of the can opener with its finishing notch engaging the pull tab of the can in the starting position of the second step of opening the can.
Figure 3B:
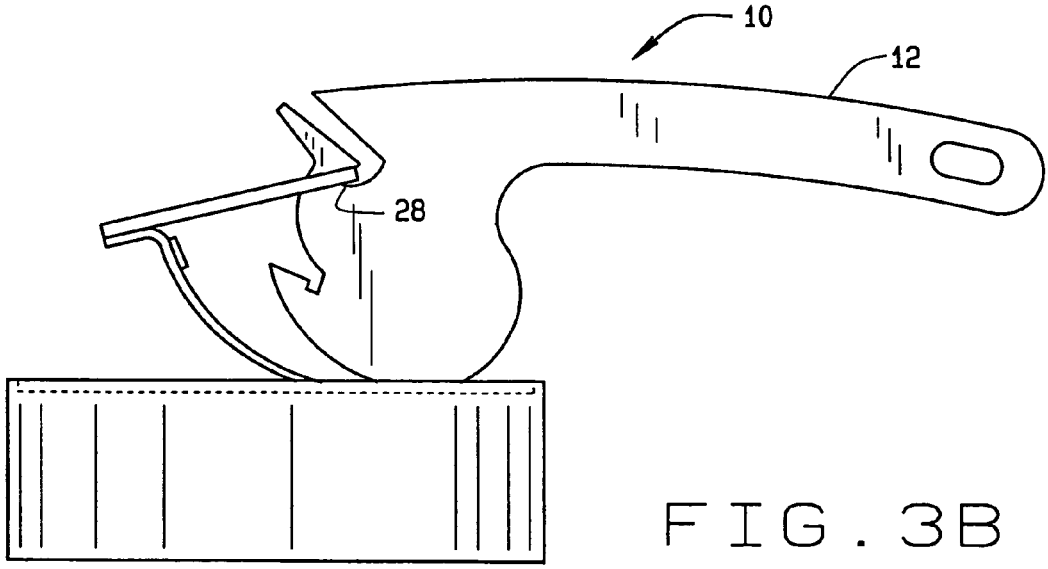
FIG. 3B is a side elevational view of the can opener with its finishing notch engaging the pull tab of the can in the finished position of the second step of opening the can, showing the can opened.

The operation of the opener is shown in FIGS. 2, 3A and 3B. Initially, the anvil tip 35 is urged under the end T2 of the tab T and through the tab hole H until the end edge of the tab is received in the notch 26. When this is done, the handle 12 will be at a substantial angle with respect to the can lid L, as seen in FIG. 2. With the bottom surface 18 resting on the can lid, the handle 10 is pivoted downwardly to pivot the opener body 14 and raise the notch 26. The pivoting of the body 14 relative to the can lid L will cause the opener to raise the end of the pull tab T. The body 14 is rotated until the pull tab T is lifted to a position in which the seal between the can lid L and the can wall SW is broken. The pull tab breaks the seal of the can generally when the pull tab T is lifted to an angle of between 45° and 90° relative to the can lid L. As can be seen, the heel 23, with its curved edge, defines a fulcrum about which the opener body pivots during use.

After the tab T has been lifted, the starting notch 26 is disengaged from the pull tab T; and the opener 10 is repositioned to engage the finishing notch 28 with the pull tab T, as seen in FIG. 3A. This is done by passing the lip 36 through the tab hole H until the end of the tab engages the back of the channel 42 or the notch 28. The body heel is then again rested on the can lid L. As can be appreciated, by changing the notch which engages the pull tab T, the rotational position of the body 14 (and hence of the handle 12) is changed. When the first step (i.e., raising the pull tab) is completed, the handle 12 forms a small angle with the can lid L. After repositioning the opener so that the pull tab ring is received in the finishing notch 28 or its port 42, the handle 12 again forms a substantial angle with the can lid L, as seen in FIG. 3A. The handle 12 is again pivoted downwardly to pivot the body 14. As the body 14 pivots, the finishing notch 28 is moved upwardly and rearwardly. This pivoting action of the body causes the notch 28 to raise or lift and remove the can lid L from the can, thereby opening the can, as seen in FIG. 3B.

Depending on the material from which the can lid is made (some can lids are springier than others) and depending on the manner in which the can lid is secured to the can wall, the can lid can spring or bounce, creating a mess. However, the channel 42 forms a retainer which prevents the can from becoming disengaged from the opener. Hence, the lid will stay on the opener, to be removed from the opener by the operator.

Figure 4:
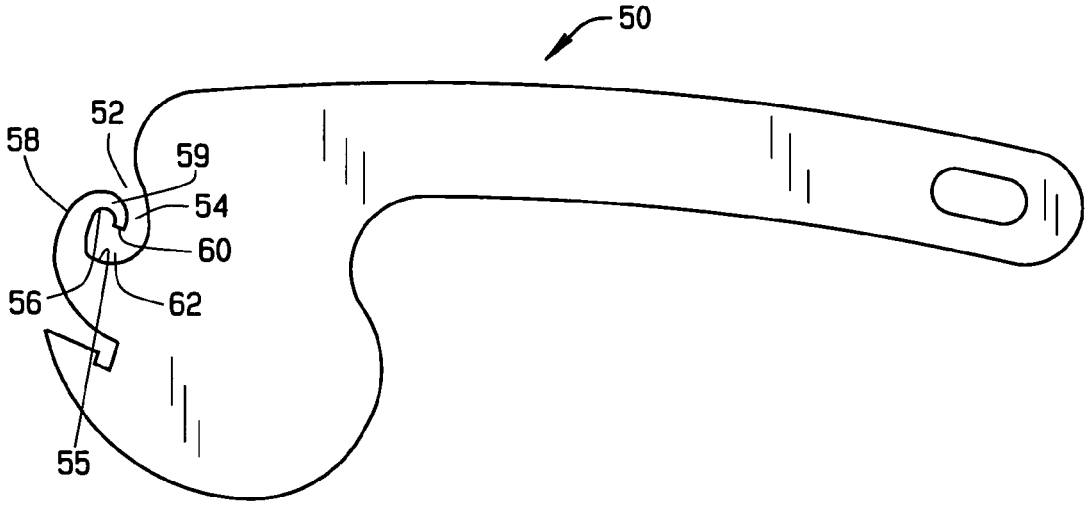
FIG. 4 is a plan view of a second illustrative embodiment of the can opener.

A second embodiment of the opener 50 is shown in FIG. 4. The opener 50 is generally similar to the opener 10. It differs only in the configuration of the finishing notch, the second port, and the retainer. The second port 52 opens generally upwardly. A channel 54 extends from the port 52 to the finishing notch 55 and continues upwardly to a retaining notch 56. The channel 54 is curved (rather than straight) and curves downwardly and forwardly into the finishing notch 55 which engages the pull tab during opening of the lid. The forward edge 58 of the opener leads to a lip 59 which curves around to generally downwardly extending to point 60. The point 60, in conjunction with the bottom edge of the curved channel 54, defines an opening 62 into the finishing notch 56. The opening 62 is shorter than the notch. Hence, the notch 56 has a height greater than the height of the opening 62. The curved lip 59, which extends over the notch 56, forms the retaining notch 56 for the opener. Operation of the opener 50 is substantially identical to operation of the opener 10.

Figure 5:
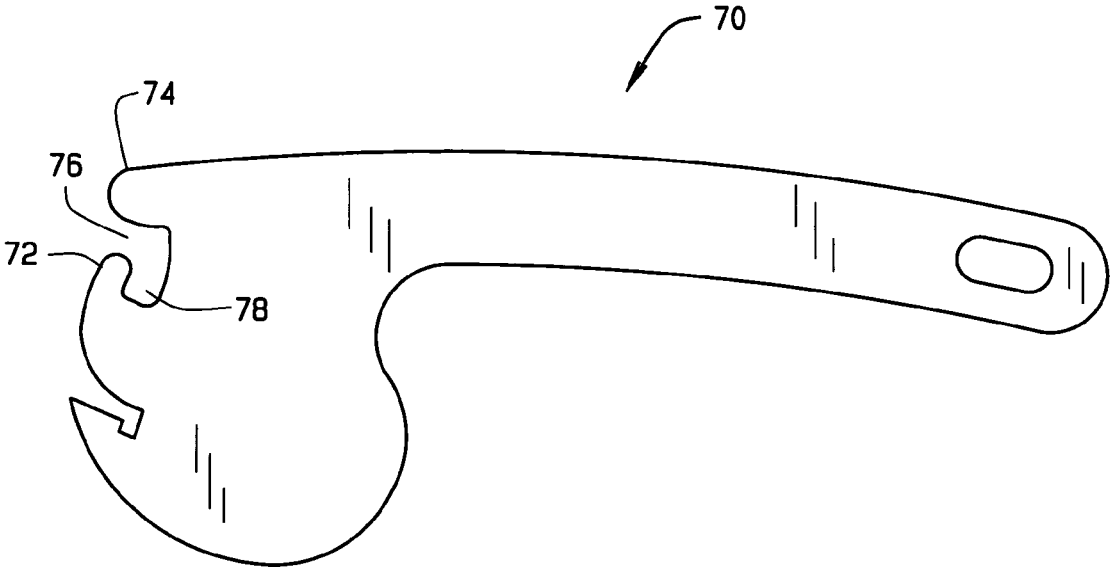
FIG. 5 is a plan view of a third illustrative embodiment of the can opener.

The opener 70 shown in FIG. 5 shows another variation on the finishing port. The opener 70 is otherwise substantially similar to the opener 10. The opener 70 has a generally upwardly directed lip 72 and a forwardly extending lip 74 at the top of the opener body. The lips 72 and 74 define the second port 76 which extends generally rearwardly from the forward edge of the opener. The finishing notch 78 is adjacent the lip 72 and below the lip 74. Hence, the port 76 and notch 78 in combination, form an L-shaped channel. Again, operation of the opener 70 is substantially identical to operation of the opener 10, as described above. In the opener 70, the upper lip 74, which extends over the notch 78, defines the retainer which holds the pull tab on the opener after the lid has been removed from the can.

Figure 6:
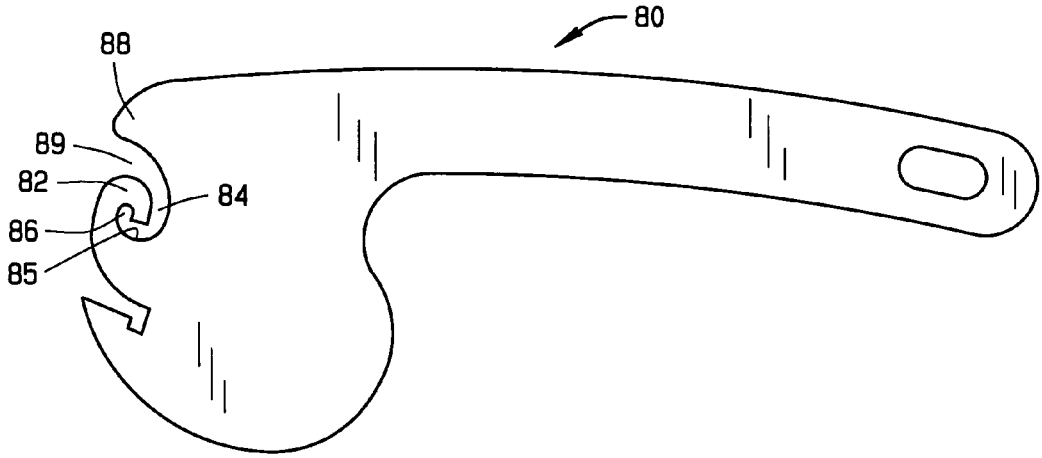
FIG. 6 is a plan view of a fourth illustrative embodiment of the can opener.

The opener 80 of FIG. 6 shows a further variation of the finishing notch and second port. The opener 80 includes a lip 82 which curves similarly to the lip 59 of the opener 50 (FIG. 4) to form a channel 84, the second or finishing notch 85 and the retaining notch 86. Like the opener 70, the opener 80 also includes a forwardly extending upper lip 88, such that the port 89 is a more forwardly opening port (as opposed to a more upwardly opening port). The upper lip 88 gives the channel 84 a more spiral appearance. In the opener 80, the curved channel 84 and the lip 82 in combination, form the retaining notch 86 which holds the lid on the opener after the lid has been removed from the can.

Figure 7:
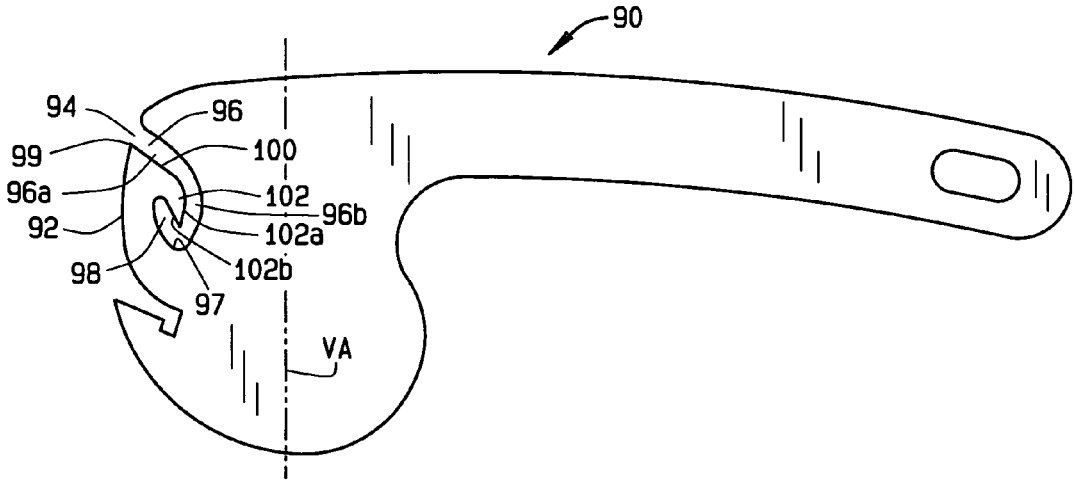
FIG. 7 is a plan view of a fifth illustrative embodiment of the can opener.

The opener 90 in FIG. 7 is somewhat similar to the opener 80 (FIG. 6). The opener 90 includes a curved surface 92 which extends upwardly from the starting notch. A port 94 is formed above the surface 92 in the forward edge of the opener body front. The port 94 opens into a channel 96 which has an initial straight section 96*a* and a curved section 96*b* which leads to the finishing notch 97. The channel 96 then extends generally diagonally upwardly to form a retaining notch 98. The channel section 96*a* is generally flat and intersects with the surface 92 at an acute angle, preferably at a point 99. The channel 96 and notches 97 and 98 are defined or formed in part by a sloped flat surface 100 which extends inwardly from the point 99 and a finger 102 which extends downwardly from the end of the surface 100. As with the opener 10, the surface 100 forms an angle of between about 55° and about 65° with the vertical axis VA of the opener body. The finger 102 has a curved edge 102*a* which forms a surface of the channel 96 and an edge 102*b* which forms a surface of the notches 97 and 98. In this embodiment, the finger 102 and the extended spiral channel 96 form the retainer.

Figure 8:
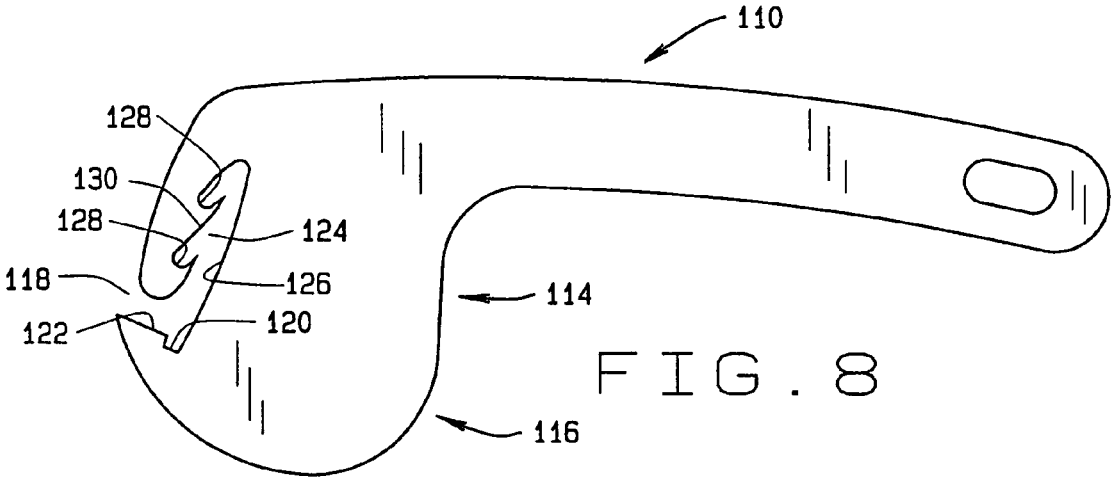
FIG. 8 is a plan view of a sixth illustrative embodiment of the can opener.
Figure 9:
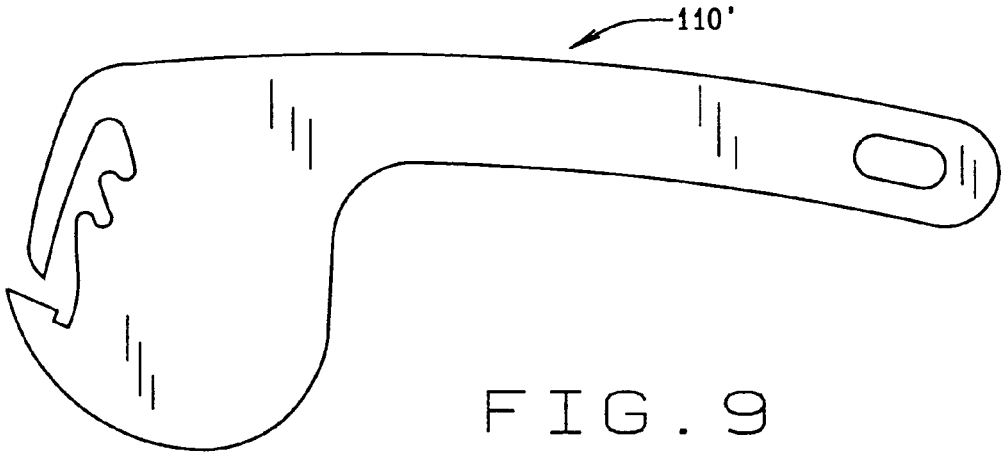
FIG. 9 is a plan view of an seventh illustrative embodiment of the can opener.

The opener 110 of FIG. 8 has a single port, rather than two ports. The opener 110 has a body 114 with a curved heel 116 similar to the heel of the opener 10 (FIG. 1). At the forward end of the heel, the body 114 includes a port 118 which extends rearwardly from the forward edge of the opener body and opens into the starting notch 120. As with the opener 10, the notch 120 is below the surface 122 which defines the port. A channel 124 extends upwardly from the port 118. The channel has a generally smooth back surface 126 and two notches 128 formed in the front surface 130. The notches 128 give the appearance of hook barbs. The two notches 128 define the finishing notches of the opener. The provision of two finishing notches allow for opener 110 to be applied to the pull tab in one of two alternative positions. The user may find one position to be more advantageous than the other depending on the size of the pull tab hole or the size of the pull top lid. In the opener 110, the channel 124 forms the retainer. The finishing notches 128 can also be formed on the back surface of the channel as seen in the opener 110' in FIG. 9.

The operation of the opener 110 is substantially similar to the operation of the opener 10 as described above. Initially, the starting notch 120 is engaged with the pull tab, as described above, and the pull tab is pivoted to break the seal in the can. The starting notch is then disengaged from the pull tab. However, rather than removing the opener from the pull tab, as occurs with the opener 10, the end edge or ring of the pull tab is slid along the channel 124 and a selected one of the finishing notches 128 is engaged with the pull tab. The opener is then pivoted again to pry the lid off the can, as described above.

The opener 130 (FIG. 10) is a variation of the opener 110. The opener 130 also includes a single port 132 which opens into the starting notch 134. A channel 136 extends upwardly from the notch 134. However, the opener 130 has only one finishing notch 138 which extends forwardly and downwardly from the top of the channel 136 to define a hook or barb 140. As seen, the channel 136 bends forwardly near its top as at 139 so that the notch 138 can extend downwardly from the top of the notch to be generally parallel to the main branch of the channel 136. The opener 130 also includes a rebound or retaining slot 142 which extends rearwardly from the channel 136. The notch 138 and the rebound/retaining slot 142 form an angle of about 80° to about 100°. The rebound slot 142 forms the retainer and, should the pull tab bounce when the lid is pried off the can, the tab will move from the finishing notch to the rebound/retainer slot 142. Additionally, it is noted that the body of the opener 130 includes a bump 144 on the top of the body and which extends above the opener's handle. This bump 144 gives the body a somewhat egg-shaped configuration. The opener can be formed without the bump.

Figure 10:
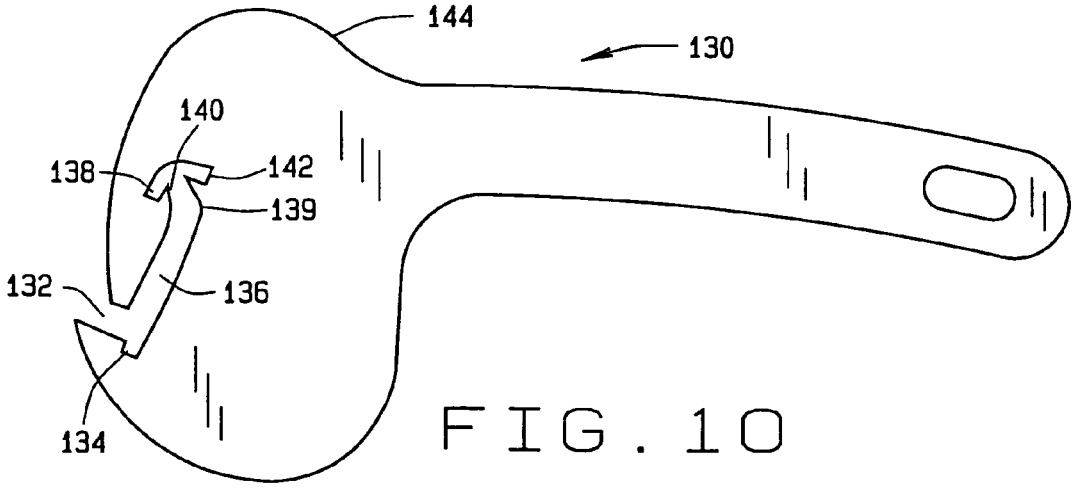
FIG. 10 is a plan view of a eighth illustrative embodiment of the can opener.
Figure 11:
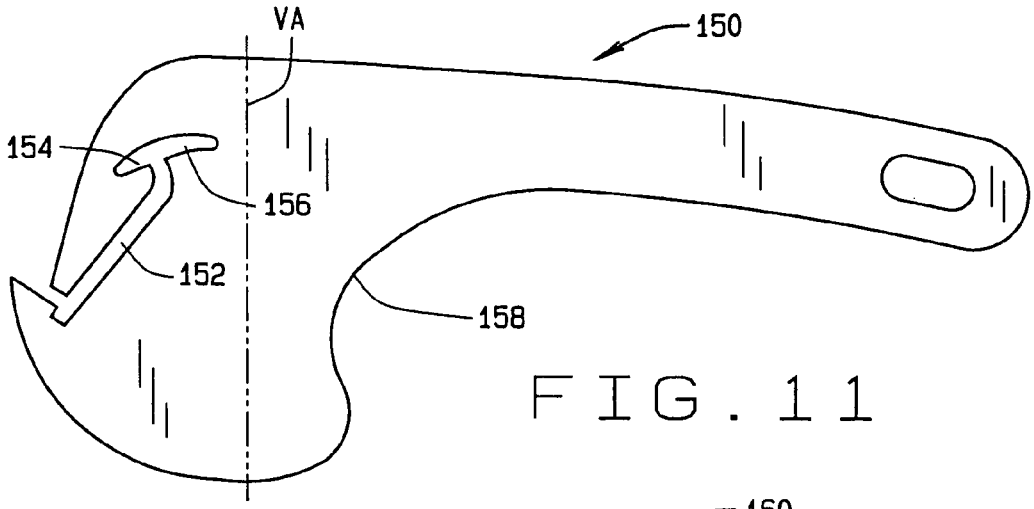
FIG. 11 is a plan view of a ninth illustrative embodiment of the can opener.

The opener 150 (FIG. 11) is also a single port opener, generally similar to the opener 130 (FIG. 10). However, in the opener 150, the channel 152 slopes rearwardly more than does the channel 136. Thus, where the channel 136 (FIG. 10) forms an angle of about 10° to about 20° with the vertical axis VA of the opener 130, the channel 152 forms an angle of about 40° to about 50° with the vertical axis VA of the opener 150. Additionally, the finishing notch 154 slopes more forwardly of the channel 152 (rather than being generally vertical), and the rebound/retainer slot 156 forms an obtuse, rather than an acute, angle with the channel 152. In view of the change of orientation of the channel, the finishing notch and the rebound slot, the finishing slot and rebound notch define an angle of between about 150° and 160°. It will also be noted that the back edge 158 of the body is generally concave from the handle to the bottom of the body. This shape to the back edge of the body forms a seat for the user's hand when the handle is gripped from below, rather than from above.

Figure 12:
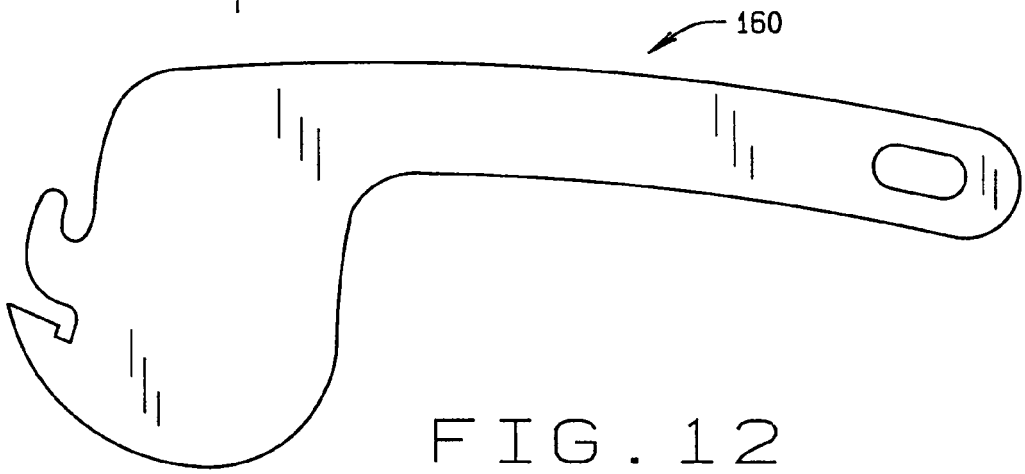
FIG. 12 is a plan view of a tenth illustrative embodiment of the can opener.

The opener 160 (FIG. 12) is similar to the opener 70 (FIG. 5). However, the opener 160 lacks the upper lip or extension of the opener 70, and hence lacks a retainer. Therefore, when the opener 160 is used, the can lid L could pop off the opener. While the opener 160 will work equally as well as the other openers, to remove the lid L from the can C, it lacks a retainer, which, as noted above, is preferably provided so that the lid L does not pop off the opener when the lid is initially freed from the can.

Figure 13:
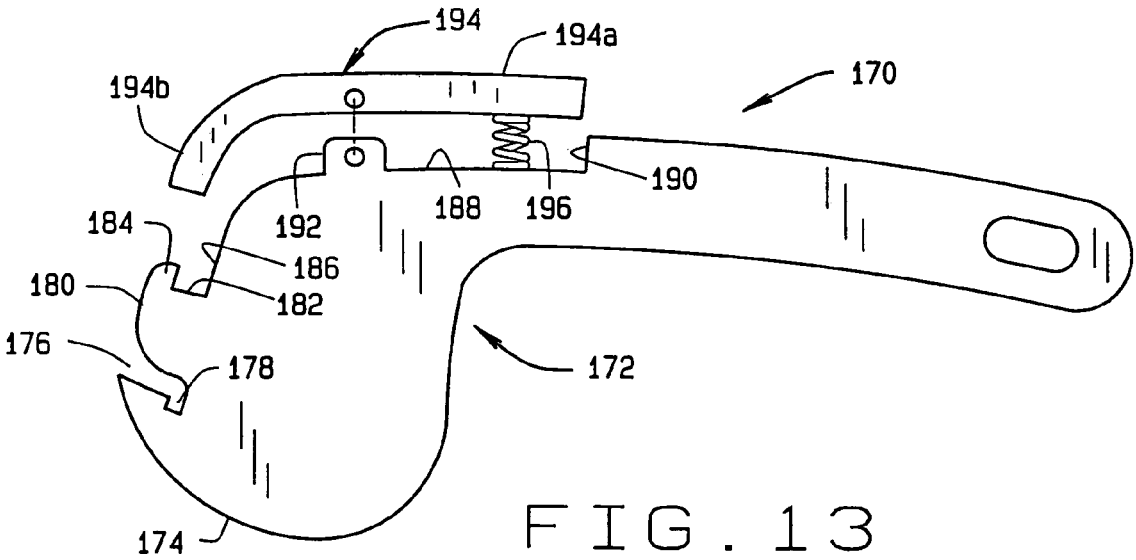
FIG. 13 is a plan view of an eleventh illustrative embodiment of the can opener.

The openers of FIGS. 1 and 3-12 are all one-piece unitary openers with no moving parts. The opener 170 (FIG. 13), as will be described, has a lever which closes the finishing notch and forms a movable retainer. The opener 170 includes a body 172 having a curved heel 174. A first port 176 opening into a starting notch 178 is formed just above the heel. The forward edge 180 of the body 172 is curved above the port 176, and an upwardly opening finishing notch 182 is formed at the top of the edge. 180. The notch 182 is defined in part by a generally vertically extending lip 184. The inner or back surface of the notch 182 is defined by a generally vertical edge 186. The edge 186 curves around to the top edge 188 of the body 172, which is spaced below the top edge of the handle. Hence, a shoulder 190 or step is formed between the handle and the body. A fulcrum 192 extends upwardly from the body top edge 188 between the front of the top edge 188 and forwardly of the shoulder 190. A lever 194 is pivotally mounted to the fulcrum 192 approximately midway along the length of the lever. The lever 194 is shaped to correspond generally to the shape of the top and front surface of the body. Hence, the lever 194 includes a generally horizontal portion 194*a* which bends or curves over to a generally vertical portion 194*b*. The lever is pivotal between a first, closed, position in which the end of the lever vertical portion 194*b* engages the top of the lip 184 and a second, opened, position in which the lever vertical portion 194*b* is spaced from the top of the lip 184. Preferably, a spring 196 is provided rearwardly of the fulcrum 192 to bias the lever normally to the first, closed, position. The back end of the lever can be pressed downwardly to move the lever from the first to the second position, and released to allow the lever to move back to the first position under pressure of the spring 196. The spring is shown to be a coil spring, but could be any type of spring material that will bias the lever handle to the closed position. When the lever is moved to its second open position, the space between the end of the vertical portion and the top of the lip define the second port. When the lever is in its first closed position, the lever will retain the lid on the opener when the lid is pried off the can.

Figure 14:
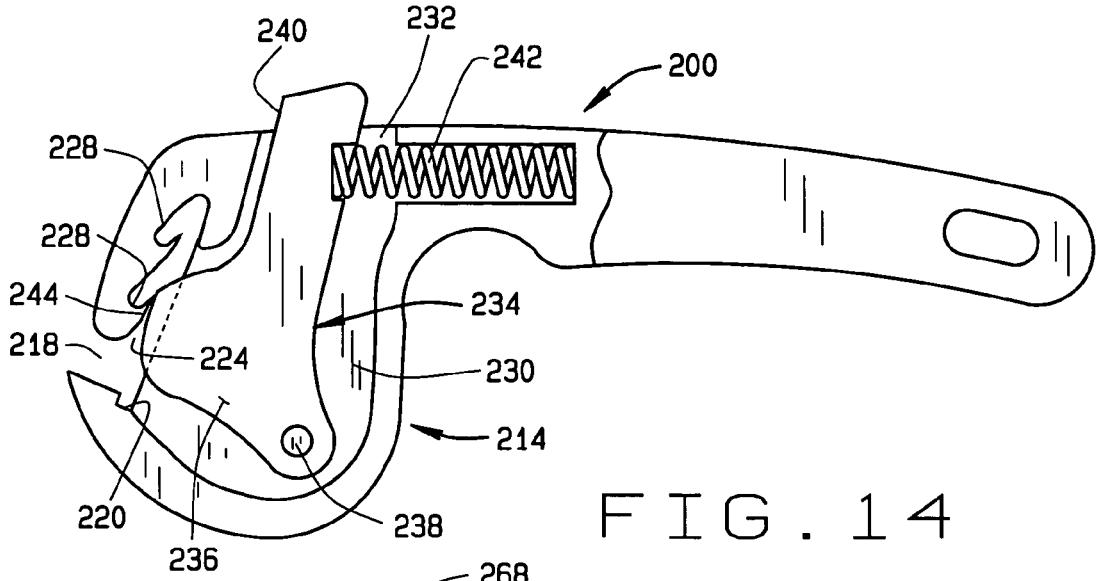
FIG. 14 is a plan view, partially cut away, of an opener similar to the opener of FIG. 8 provided with an internally moveable retainer.
Figure 15:
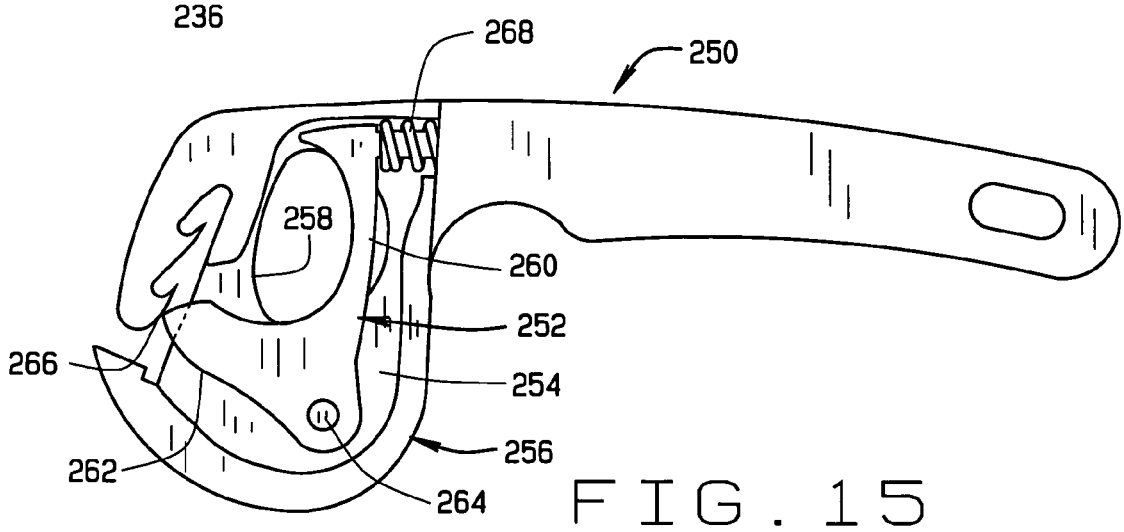
FIG. 15 is a plan view, partially cut away, of an opener similar to the opener of FIG. 8 with a second internally movable retainer.

FIGS. 14 and 15 show two openers similar to the opener 110 (FIG. 8) and which are provided with moveable retainers. Turning first to FIG. 14, the opener 200 has a body that is shaped substantially identically to the body 114 of the opener 110, and hence, will not be discussed in detail. The body 214 does include a starting notch 220 and finishing notches 228 spaced along a channel 224. The starting and finishing notches are accessible through a port 218. The body 214 is provided with a cavity 230 which is open at the top of the body to define a slot 232.

A movable retainer 234 is received in the cavity 230. The retainer 234 includes a retainer body 236 which is fixed in the cavity 230 for pivotal movement about an axis 238. The retainer body can be secured in the cavity by means of a pin, shaft, bolt or the like, and the pin, shaft, bolt or the like will then define the axle about which the retainer body rotates.

The movable retainer includes a handle 240 which extends upwardly from the retainer body 236 and protrudes out through the slot 232 at the top of the opener body 214. Using the handle 240, the retainer can be pivoted between a forward position and a rearward position. Preferably, a spring 242 is provided to bias the retainer to the forward position.

The retainer body includes a forward surface or edge 244 which, when the retainer is in the forward position, contacts or engages the bottom of the lower finishing notch 228, as seen in FIG. 14. As can be appreciated, this closes the channel 224. The retainer body forward surface 244 is shaped to allow a user to slip the pull tab ring into the channel 224 without the need to move the retainer handle 240 rearwardly.

The opener 200 would be used substantially in the same way as described above with the opener 110. Initially, the starting notch 220 is engaged with the pull tab, and the pull tab is pivoted to break the seal in the can. The starting notch is then disengaged from the pull tab, and the end edge or ring of the pull tab is slid along the channel 224 and a selected one of the finishing notches 228 is engaged with the pull tab. The retainer is in the forward or closed position when the tab is slid into the channel 224. However, due to the shape of the forward edge, as the tab is slid into the channel 224, the retainer will pivot rearwardly to allow the tab to pass into the channel. Once the tab is in the channel, the retainer, under bias of the spring 242, will move back to the closed position. With the tab engaged in one of the finishing notches 228, the opener is then pivoted again, as described above, to pry the lid off the can. When the lid has been removed from the can, the movable retainer 234 will positively retain the tab in the opener channel 224. The retainer handle 240 can be pulled rearwardly to open the channel. With the channel open, the tab and lid can be removed from the opener.

The opener 250 of FIG. 15, like the opener 200, is based on the opener 110 (FIG. 8). The opener 250 is provided with a moveable retainer 252 which pivots within a cavity 254 in the opener body 256. The opener body 256 is provided with a through hole 258 which is open on both sides of the opener body 256. Rather than having a thumb operated handle, as does the retainer 234 (FIG. 14), the retainer 252 includes an upper portion 260 at least a portion of which is exposed in the opening 258 and can be pulled rearwardly, in the manner of a trigger. That is, the upper portion 260 forms a secant with respect to the opening 258.

The movable retainer 252 also includes a retainer body 262 (from which the upper portion 260 extends). The retainer body 262 is pivotally mounted in the cavity 254 to pivot about an axle 264. The retainer body 262 includes a forward surface or edge 266 which engages the finishing notch to close the channel. The retainer 252 is biased to a closed position by means of a spring 268.

Operation of the opener 250 is substantially identical to the operation of the opener 200.

Figure 16:
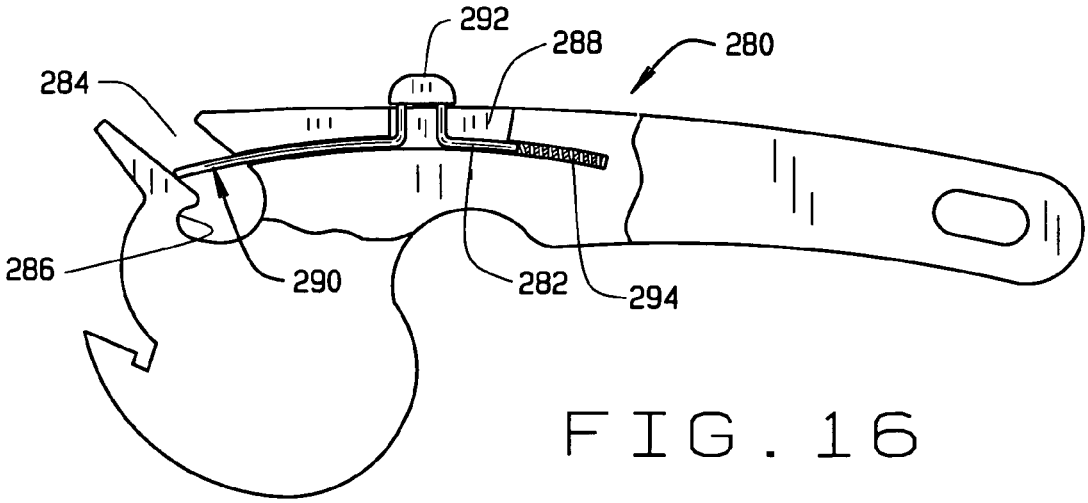
FIG. 16 is a plan view, partially cut away, of an opener similar to the opener of FIG. 1 with an axially slidable retainer.
Figure 17:
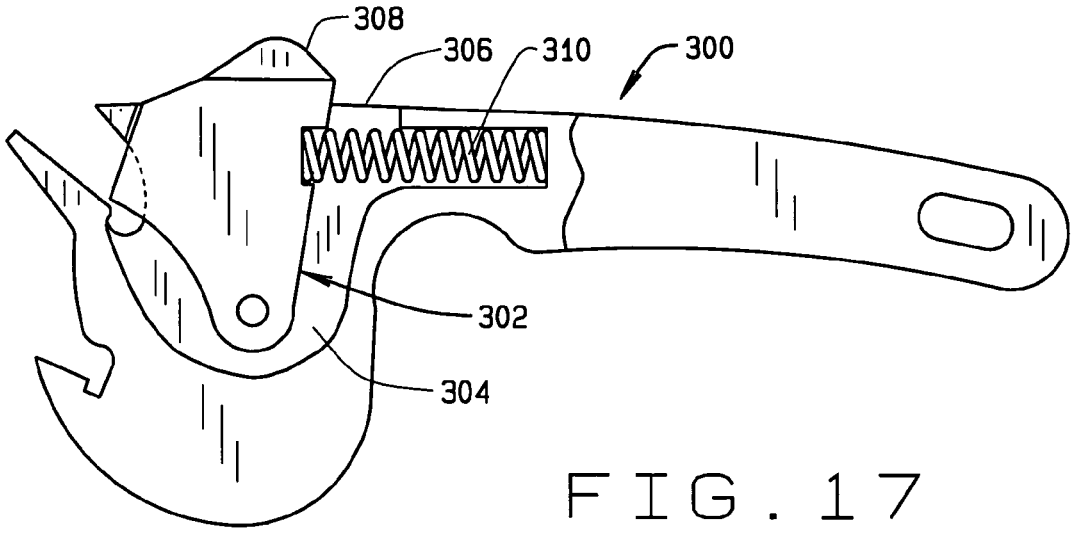
FIG. 17 is a plan view, partially cut away, of an opener similar to the opener of FIG. 1 provided with an internally pivoting retainer.
Figure 18:
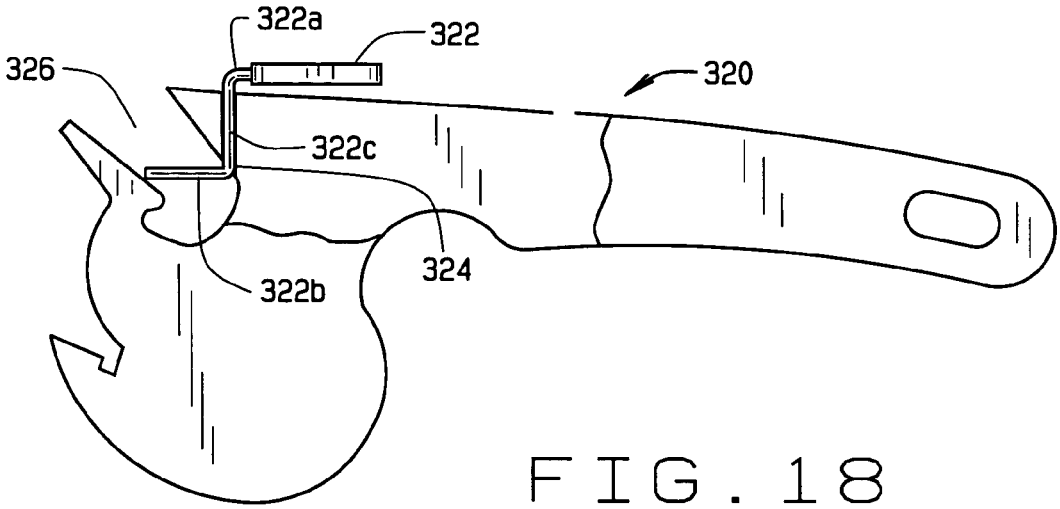
FIG. 18 is a plan view, partially cut away, of an opener similar to the opener of FIG. 1 with a swinging retainer.

The openers of FIGS. 16-18 are all based on the opener 10 (FIG. 1) and each has a body substantially identical to the body 14 of the opener 10. Turning to FIG. 16, the opener 280 has a channel 282 which extends through the opener handle and head to open into the channel 284 through which the finishing notch 286 is accessible. The handle includes a slot 288 which communicates with the channel. The slot 288 is shown to be slightly curved. However, the slot could be straight if desired. The slot is positioned between the ends of the channel. A movable retainer 290, in the form of a wire or rod, is received in the channel 282. The retainer wire or rod 290 is provided with a handle member 292 which extends through the slot 288. The handle member 282 is shorter than the slot 288 to enable the handle member 282 to be moved axially relative to the slot, and hence, to allow for axial movement of the wire 290 relative to the channel 282. Lastly, a spring member, such as a coil spring 294, is positioned in the rear of the channel 282. The retainer wire has a length such that, when the spring is extended (or relaxed), the forward end of the retainer wire 290 engages the lip defining the channel 284 to close the channel. The spring 294 biases the wire 290 towards this closed positioned, and, by pulling back on the handle 292, the wire 290 will be moved rearwardly to open the channel 284. The opener 280 will operate substantially similarly to the opener 10 (FIG. 1) as described above. However, in order to position the tab in the finishing notch, the retainer wire 290 will have to be moved rearwardly to the open position.

The opener 300 (FIG. 17) while based on the opener 10 (FIG. 1) includes a pivoting movable retainer 302 which is similar to the movable retainer 234 of the opener 200. The opener 300 includes a cavity 304 in which the movable retainer 302 is pivotally mounted. The cavity is open at its top to define a slot 306 in the top of the opener body, and a retainer handle 308 extends through the slot to be accessible by a user. The movable retainer 302 is pivotable between a forward position and a rearward position, and is shaped, such that in its forward position, the retainer 302 will close the finishing notch, to retain a tab within the notch, and in its rearward position, the finishing notch is opened. Additionally, the forward edge of the retainer 302 is shaped such that the ring of a can's pull tab can be engaged with the finishing notch without the need to manually move the retainer from the forward closed position to the rearward open position. Lastly, the movable retainer 302 is biased to its forward closed position by means of a spring 310.

The opener 320 (FIG. 18) is provided with a retainer 322 which pivots or rotates about a vertical axis, rather than about a horizontal axis, as do the movable retainers 234, 252 and 302. The opener 320 is provided with a channel 324 which extends downwardly from a top edge of the opener and opens into the channel 326 which leads to the finishing notch. The movable retainer 322 comprises a generally "S"-shaped rod, having a upper and lower portions 322*a,b* joined by an axle portion 322*c*. As can be appreciated, by pivoting the upper portion 322*a* horizontally, the lower portion 322*b* will also pivot horizontally.

The movable retainer lower portion 322*b* extends from the exit of the channel 324 and is sized, such that when the upper and lower portions are generally aligned with the axis or plane of the opener 320, the end of the retainer lower portion 322*b* will engage the forward edge of the channel 326 opposite the opening of the channel 324. When the movable retainer 322 is aligned or parallel to the plane of the opener 320, the channel 326 will be closed, to retain a tab within the finishing notch, and when the retainer 322 is pivoted out of alignment with the opener, the channel 326 will be opened, to allow a tab to be removed from the opener or to allow the tab to be engaged with the finishing notch. The forward end of the retainer lower portion could be configured such that the retainer would be pivoted as a tab is slid down the channel 326 to engage the finishing notch. Additionally, a spring, such as a torsion spring, could be provided to bias the retainer 322 to its closed position.

The foregoing openers all have a single handle. The openers shown in FIGS. 19-25 and described below are all two-handled openers with movable retainers. The two-handled openers are based on the opener 10 of FIG. 1 which includes a starting notch spaced below a finishing notch, each of the two notches having their own ports. The two-handled openers of FIGS. 19-25 provide additional movable retainers for the finishing notches of the openers.

Figure 19:
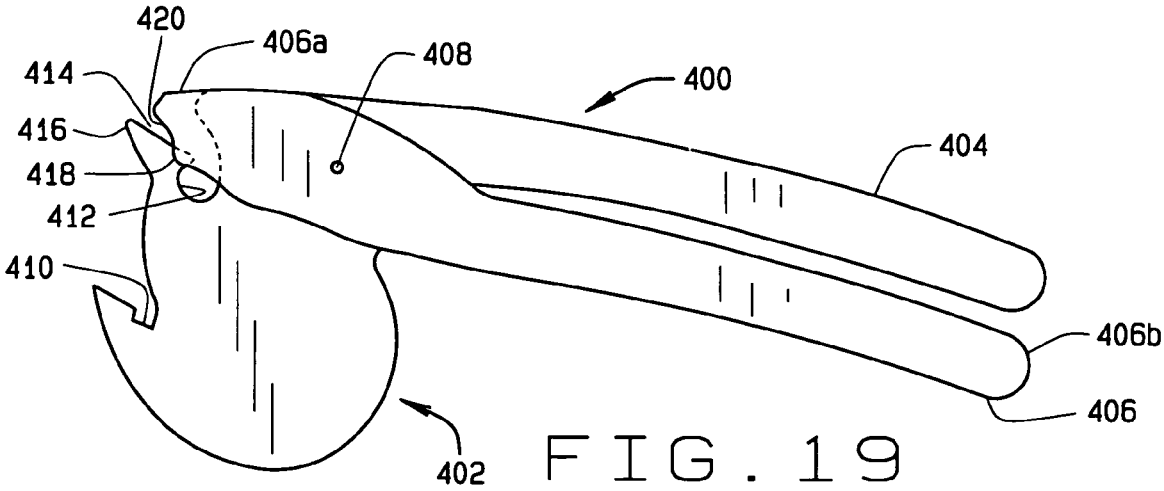
FIGS. 19 and 20 are plan views of an opener similar to the opener of FIG. 1 but provided with two handles.
Figure 20:
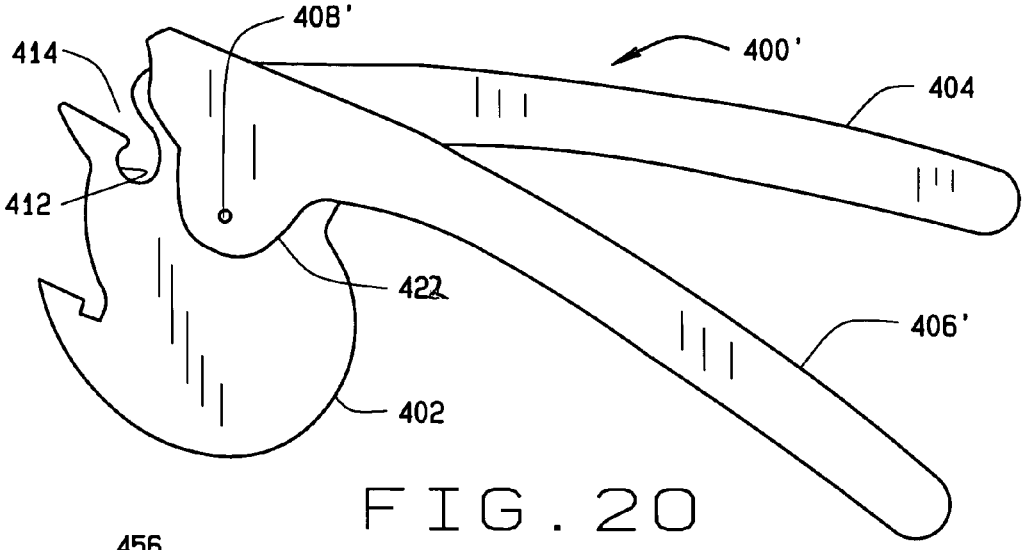

Referring to FIG. 19, the opener 400 includes an opener body 402, a first handle 404 which is fixed to the body 402 and a second handle 406 which is pivotally connected to the body 402. The second handle 406 has a forward end 406*a* and a rear or back end 406*b*. The second handle is pivotally connected to the body between the two ends 406*a,b* by an axle 408 which can be in the form of a pin, bolt, or any other conventional member which can serve to connect the second handle 406 to the body 402 and which will allow the second handle 406 to rotate or pivot about the axle 408 relative to the first handle 404 and the opener body 402.

The opener body includes a starting notch 410 and a finishing notch 412 spaced above the starting notch 410. The starting notch 410 is substantially identical to the starting notch 26 of FIG. 1, and will not be further described herein. The finishing notch 412 is accessed by a port, channel or opening 414 (best shown in FIG. 20) at the top of the forward end of the opener body 402. The channel 414 is formed in part by a lip 416 which is substantially similar to the lip 36 of the opener 10 (FIG. 1). The channel 414, however, is larger in width than the corresponding channel 42 of the opener 10. The forward end 406*a* of the second handle 406 is shaped to include a nub or small projection 418 along the forward edge 420 of the second handle 406. The nub 418 is sized and shaped, such that when second handle 406 is generally parallel to the first handle 404, the nub 418 overlaps, engages, or nearly engages the lip 416, as seen in FIG. 19, thereby closing the channel 414. Hence, in this position, the handles are in a closed position. When the second handle 406 is pivoted downwardly, the nub 418 will be moved away from the lip 416, such that it no longer overlaps the lip, opening the channel 414 and placing the opener in an opened position. As can be appreciated, by pivoting the second handle 406 relative to the body 402 and the first handle 404, the opener can be placed in an open position in which the pull tab of the can being opened can be engaged by the finishing notch, and in a closed position in which the tab will be retained in the finishing notch 412 and its associated channel 414 when the can lid is pried off the can.

The opener 400' (FIG. 20) shows an opener similar to the opener 400 (FIG. 19). The opener 400' includes a body 402 and first handle 404 which are substantially similar to the body and first handle of the opener 400. The second handle 406' is also generally similar to the handle 406 of the opener 400. However, the handle 406' includes a lower rounded portion 422 which extends below the axis of the handle. 406. This rounded portion 422 forms the point of connection between the handle 406' and the body 402, and the axle 408' extends through this rounded portion 422 to pivotally connect the second handle 406' to the body 402. The opener 400' operates in the same manner as the opener 400. As can be appreciated, the opener 400' is shown in the open position in which the channel to the finishing notch 412 is opened; and as noted above, the opener 400 (FIG. 19) is shown in the closed position, in which the channel 414 is closed to retain a tab in the channel.

The opener 430 (FIG. 21) shows another two-handled opener. The opener 430 includes a body 432 having a starting notch 434 which is substantially similar to the starting notch 26 of the opener 10 (FIG. 1) at the forward edge of the body. An edge 436 extends upwardly from the notch 434, and a lip 438 extends diagonally outwardly and upwardly from the upper end of the edge 436. The upper surface of the lip 438 leads to the finishing notch 440. The body also includes an upper lip 442 which extends from the top of the body 432 over the notch 440 and which curves down slightly, forming a channel or port 444 with the lip 438 which leads to the notch 440.

Figure 21:
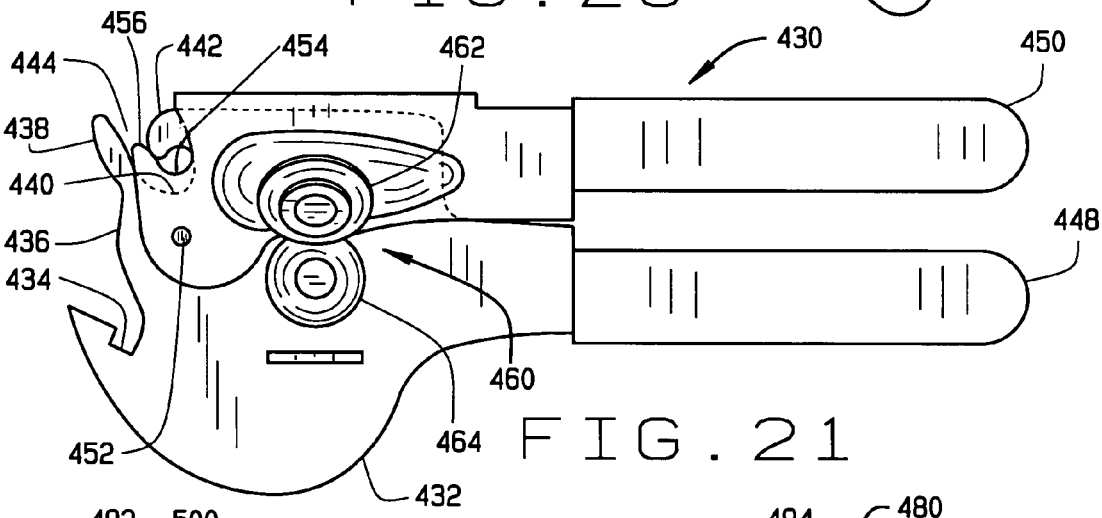
FIGS. 21-24 are plan views of two-handled openers provided with various movable retainers.

A first handle 448 extends rearwardly from the opener body 432. A second handle 450 is mounted to the body 432 to pivot with respect to the body 432 and the first handle 448. The second handle 450 is pivotally mounted relative to the body 432 and the first handle 448 by means of a bolt, pin or the like 452 towards the front of the second handle 450. The second handle 450 can move between a first position in which the second handle 450 is substantially parallel to the first handle 448, and a second position, in which the back of the second handle 450 is raised relative to the back of the first handle 448 and in which the second handle 450 forms an angle with respect to the first handle 448. A movable retainer notch 454 is formed at the front and top of the second handle 450. As seen, in FIG. 21, in which the second handle 450 is in the first position, the movable retainer notch 454 is formed to include a forward lip 456 and is sized and shaped, such that the movable retainer lip 456 comes to a position in which it is substantially aligned with (and in which it might slightly overlap) the upper lip 442 of the body 432. In this position, as seen in FIG. 21, the movable retainer notch 454 of the upper handle 450 and the finishing notch 440 and upper lip 442 combine to form a closed circle. When the second handle 450 is pivoted relative to the body 432 and the first handle 448, the movable retainer lip 456 moves away from the body upper lip 442, such that the open end of the movable retainer notch 454 is aligned with the channel 444 of the finishing notch. As can be appreciated, in the second position, the channel 444 is opened, and the lip 438 can be passed through the hole in a pull tab of a lid to pry the lid of a can. With the opener in the closed position (shown in FIG. 21), the finishing notch is closed, and the tab will be retained on the opener when the lid is pried off its can.

It will be noticed that, in the opener 430, the second, pivoting, or moveable handle 450 is an upper handle, whereas, in the openers 400 and 400', the second, moveable handle 406, 406' is the lower handle. It will also be seen that the opener 430 is provided with a disc-type vertically cutting can opener 460 such as is used to open a can which does not have a pull-tab on its lid. The disc-type vertically cutting opener 460 comprises a cutting disc and cog 462 on the upper moveable handle and a lower cog 464 on the opener body 432. The components and operation of such openers are well known in the art, and will not be further described herein.

Figure 22:
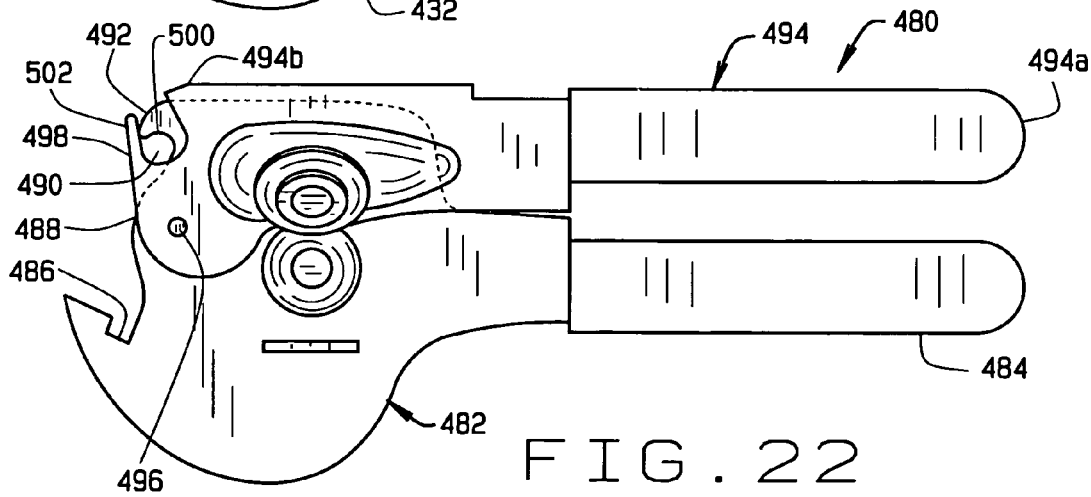

Another two-handled opener 480 is shown in FIG. 22. This opener, like the opener 430, is provided with a standard disc-type vertically cutting can opener. The opener 480 includes a body 482 having a first handle 484 fixed to, and extending rearwardly from, the body 482. A starting notch 486 is formed in the forward edge 488 of the body 482. The starting notch 486 is substantially identical to the starting notch 26 of the opener 10 (FIG. 1) and will not be further described. Upwardly of the starting notch 486, the body 482 includes a retainer notch 490. The retainer notch 490 extends rearwardly into the body 482 from the forward edge 488 of the body. The notch 490, in effect, defines a generally downwardly extending lip 492.

A second handle 494 includes a back, gripping end 494*a* and a forward end 494*b*. The second handle 494 is pivotally mounted to the opener body 482 at a pivot point or axle 496 to be selectively pivoted between a first position in which the second handle gripping portion 494*a* is generally parallel to the first handle 484, and a second position, in which the second handle portion 494*a* is raised relative to the first handle 484 to define an angle with respect thereto.

The second handle 494 includes a generally flat forward edge 498 at the front of the handle forward portion 494*b*. A channel 500 extends downwardly from the top edge of the second handle forward portion 494*b* slightly rearwardly of the forward edge 498. The channel 500 forms a generally upwardly extending lip 502 at the forward edge. The channel 500 defines the second, finishing, notch of the opener 480, and the lip 502 corresponds, for example, to the lip 36 of the opener 10 (FIG. 1). Hence, the lip 502 is sized and shaped to pass through the opening in the tab T of a can C. As seen in FIG. 22, the second handle 494 is positioned on the body 482 such that the retainer notch channel 490 and the finishing notch channel 500 can be aligned to define an opening sized to receive the ring of the tab T.

In FIG. 22, the opener 480 is shown in the first, closed position. In this closed position, the lip 492 of the retainer channel 490 extends substantially to the lip 502 of the finishing notch channel 500 to close the channel 500. When the second handle 494 is pivoted about its pivot point 496, the finishing notch lip 502 will pivot forwardly, away from the retainer lip 492, thereby opening up the finishing notch channel 500 and positioning the movable finishing notch lip 502 so that it may engage the hole or ring of the tab T.

In the opener 430 (FIG. 21), the finishing notch and associated finishing lip is on the opener body, and the movable retainer notch and associated lip is on the second, movable handle. However, in the opener 480 (FIG. 22), the finishing notch and associated lip are on the second, movable handle, and the retainer lip is on the body.

The opener 520 (FIG. 23) shows a variation of the opener 480 (FIG. 22). The opener 520 includes a body 522 having a first handle 524 fixed to, and extending rearwardly from, the body 522. A starting notch 526 is formed in the forward edge 528 of the body 522. The starting notch 526 is substantially identical to the starting notch 26 of the opener 10 (FIG. 1) and will not be further described. Upwardly of the starting notch 526, the body 522 includes an arm 530 which extends upwardly from the starting notch 526. At its top, the arm 530 includes a forwardly extending retainer finger or lip 532 that forms the retainer notch 544.

A second handle 534 includes a back, gripping end 534*a* and a forward end 534*b*. The second handle 534 is pivotally mounted to the opener body 522 to be selectively pivoted between a first position in which the second handle gripping portion 534*a* is generally parallel to the first handle 524, and a second position, in which the second handle portion 534*a* is raised relative to the first handle 524 to define an angle with respect thereto.

The second handle 534 includes an arm 536 which extends forwardly of the pivot point and has a rearwardly sloping forward surface 538. A channel 540 extends inwardly from the top edge of the arm slightly rearwardly of the arm's front edge. The channel 540 forms the finishing notch 546 of the opener, and the forward end of the arm, with the sloped forward edge 538, corresponds to the lip 36 of the opener 10 (FIG. 1). The forward end of the arm 536 thus is formed and sized to be able to pass through the ring of the tab T of a can C to be opened. Further, as seen, the channel 540 forms a finishing notch lip 542 at the top of the arm 536.

Figure 23:
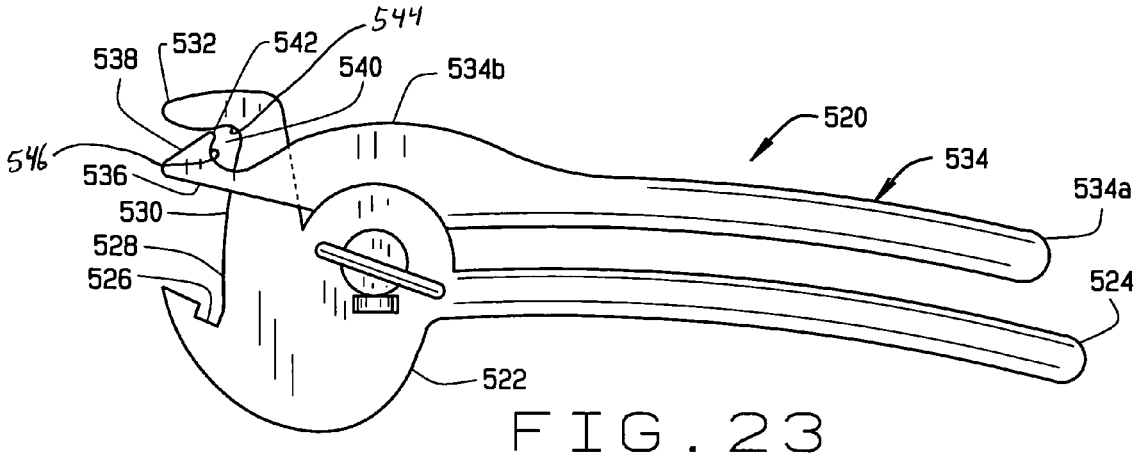

As seen in FIG. 23, when the opener 520 is in the first position (i.e., with the handles generally parallel to each other), the body arm 530 and the second handle arm 536 cross over each other, such that the retainer lip 532 of body arm 530 extends over the finishing notch channel 540 and finishing notch lip 542. The retainer arm 530 and lip 532 are sized such that in the position shown in FIG. 23, the retainer lip 532 engages, or nearly engages, the finishing notch lip 542 to close the finishing notch channel 540.

In FIG. 23, the opener 520 is shown in the first, closed position. In this closed position, as just noted, the retainer lip 532 engages, or nearly engages, the finishing notch lip 542 to close the finishing notch channel 540. When the second handle 534 is pivoted about its pivot point, the arm 536 will pivot downwardly, moving the finishing notch 546 and its associated lip 542 away from the retainer lip 532, thereby opening up the finishing notch channel 540 and positioning the finishing notch lip 542 so that it may engage the hole or ring of the tab T.

Figure 24:
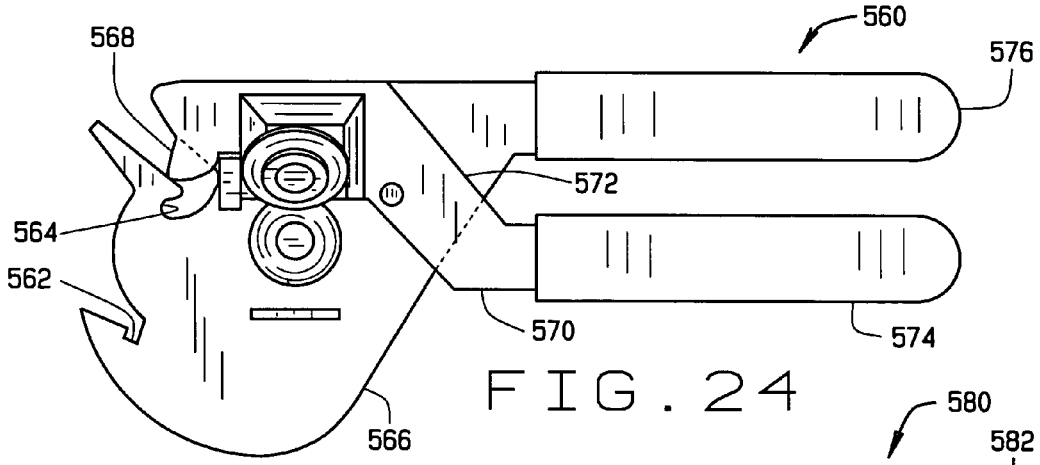
Figure 25:
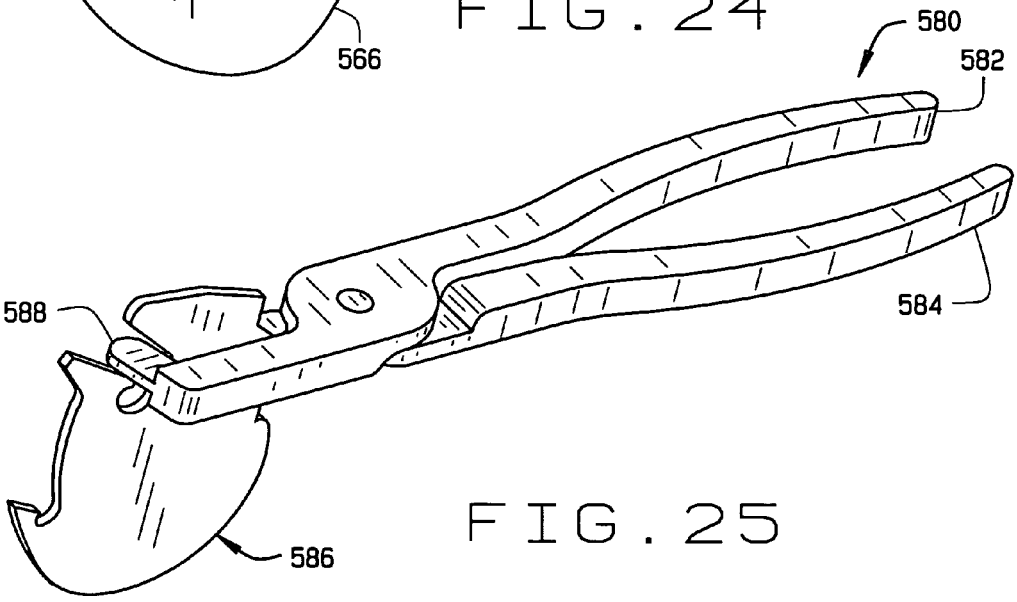
FIG. 25 is a perspective view of a two-handled opener having a head generally similar to the head of the opener of FIG. 1, and provided with a swinging retainer.

The openers of FIGS. 21, 22 and 24 show that the opener, as noted above, can be provided with a vertical cutting can opener having a cutting disc which cuts the can lid around the edge of the can to separate the can lid from the can, to thereby open the can. The opener 520, on the other hand, is provided with a horizontal or side cutting can opener, which, as is well known in the art, cuts the side wall of the can to separate the can lid from the can body.

The opener 560 (FIG. 24) is a similar in construction to the opener 430 (FIG. 21) in as much as the starting notch 562 and finishing notch 564 are both provided on the opener body 566, and that the movable retainer lip 568 is formed at the forward end of the movable handle 570. However, in the opener 560, the movable handle 570 includes a sloped section 572, such that the gripping portion 574 of the handle 570 is below the fixed handle 576. In contrast, in the opener 430 (FIG. 21), the gripping portion of the movable handle is above the fixed handle. This contrast results from moving the pivot point from the front of the body to the rear of the body. Pivot point 452 (FIG. 21) is at the front of the opener body 432. The opener 560 (FIG. 24) has a pivot point near the rear of opener body 566 in close proximity to the intersection of the two handles.

The opener 580 (FIG. 25) includes a movable retainer that swings or pivots horizontally, rather than vertically. The opener 580 includes a pair of arms 582 and 584 which are pivotally connected together between the two ends of the arms, in much the same way that the arms of a pair of pliers are connected together. An opener body 586 is at the forward end of arm 584. The opener body 586 can be substantially similar to the body 14 of the opener 10 (FIG. 1) and will not be further described herein. The opener body 586 extends in a plane that is generally perpendicular, rather than generally parallel, to the plane defined by the arms 582, 584 or handles of the opener 580. The arm 582 includes a retainer finger or lip 588 at the end thereof which extends toward the opener body 586 in a plane generally parallel to the plane defined by the arms 582, 584. The retainer lip 588 is sized and positioned to extend over the finishing notch of the opener body when the opener is in a closed position to close the finishing notch. When the opener is in an opened position, the retainer lip 588 will be horizontally spaced from the opener body 586 such that the finishing notch can receive the ring of the tab.

Figure 26:
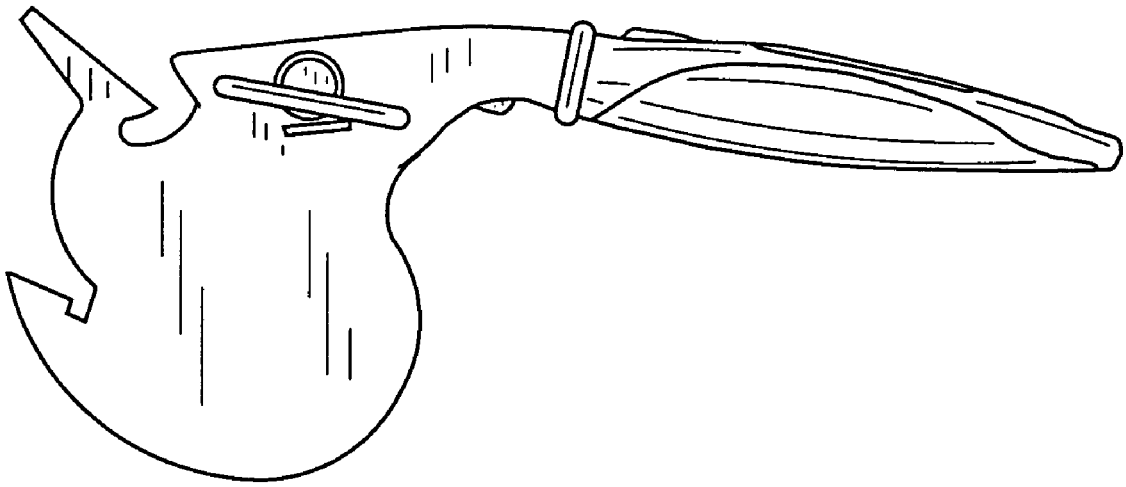
FIG. 26 is a perspective view of a can-opener, similar to the opener of FIG. 1, and including a horizontally cutting can-opener.

Lastly, the opener shown in FIG. 26 is a dual purpose opener with a single handle. That is, it includes a pull-top can opener and a horizontally-cutting can opener. The pull-top can opener is identical to the opener 10 of FIG. 1, and hence will not be described. The pull top openers of FIGS. 1-12 can be transformed into dual purpose openers by simply adding the horizontal cutting components. Thus, the opener 110 (FIG. 8) for example, can be transformed into a dual purpose opener. Horizontally-cutting can openers are well known, and also will not be described. A horizontally cutting can opener is shown, for example, in U.S. Pat. No. 6,618,886, which is incorporated herein by reference. As can be seen, the elements for the horizontally-cutting can opener are at the forward end of the handle, at the junction of the handle with the pull-tab can opener body. FIG. 26 shows a single handle pull-tab can opener in conjunction with a horizontally-cutting can opener mechanism. The dual purpose opener of FIG. 26 is based on the two port opener of FIG. 1. It will be appreciated that the pull-tab can opener could also be used in conjunction with a standard vertically cutting can opener. In this instance, the pull-tab can opener body would be formed at the end of the fixed handle. Although, it could also be mounted at the end of the movable handle. Such a dual-type can opener would be somewhat similar to the opener 560 of FIG. 24.

In view of the above, it will be appreciated that the various openers are provided. The openers all have a starting notch (or hook) and a finishing notch (or hook) and require repositioning of the opener body relative to the can between lid opening steps. The repositioning of the body to the finishing hook raises the handle to provide additional leverage to the user—thereby making opening of the can easier. The opener can be provided with a retainer to hold the can lid when the lid is removed from the can. The retainer can be either a stationary retainer (as seen in FIGS. 1-11 and 26) or a movable retainer (as seen in FIGS. 13-25). Also, as described, the opener can be mated with a traditional side (horizontally) cutting or top (vertically) cutting can opener, so that the opener can be used with both plain top cans and pull tab top cans.

As various changes could be made in the above constructions without departing from the scope of the invention, it is intended that all matter contained in the above description or shown in the accompanying drawings shall be interpreted as illustrative and not in a limiting sense. For example, although it is preferred to provide the opener with a handle, a handle is not necessary. Additionally, as noted in FIG. 12, a retainer is not necessary to the operation of the opener. These examples are merely illustrative.

The invention claimed is:

1. A can opener for a pull top-type can, the opener comprising:

a body comprising a front surface, a rear surface, and a bottom surface, said body defining a heel; said heel having a curved edge comprising a curved front surface, said bottom surface, and at least a portion of said body rear surface; said curved front surface and said bottom surface defining a continuously curving edge with a smooth transition between said heel front and bottom surfaces to define a fulcrum about which said body can be pivoted; said fulcrum being shaped to enable the opener to lift a tab of a pull-top type can off a top of the can and to remove the top of the can from the can; said curved surface defining a first radius at a forward portion of said heel and a second radius at a back portion of said heel; said first radius being larger than said second radius;

a tab engaging lip having a flat surface extending rearwardly from an upper, forward end of said heel front surface; said lip flat surface forming an acute intersection with said heel front surface to enable said lip to be inserted under a can tab; said lip having a length less then the diameter of a ring of a pull-top can opening tab, said lip flat surface being angled relative to said forward end of said heel front surface to form an acute angle therewith and such that an imaginary line extending from, and collinear with, said lip flat surface intersects a back of said heel at said rear surface of said body; and a starting notch generally above said heel forward portion at an end of said flat surface opposite said intersection between said flat surface and said heel front surface, said starting notch being defined by a forward surface, a bottom surface, and a back surface; said starting notch forward surface intersecting said lip flat surface and extending toward said heel to define an angle with said lip flat surface to form an abrupt transition between said flat surface and said notch.

2. The can opener of claim 1 including a handle, said body being formed at one end of said handle.

3. The can opener of claim 1 wherein said opener includes a generally upwardly facing finishing notch, said finishing notch being spaced above said starting notch, said finishing notch being forward of said bottom surface.

4. The can opener of claim 3 including a port opening into said starting notch from said front surface of said body.

5. The can opener of claim 4 wherein said port is a first port, said opener including a second port spaced above said first port; said second port communicating with said finishing notch.

6. The can opener of claim 5 wherein said body includes a retainer sized and shaped to at least partially close an entrance to said finishing notch.

7. The can opener of claim 6 wherein said second port defines a spiral path; said second port surfaces defining said retainer.

8. The can opener of claim 4 including a channel extending to said finishing notch.

9. The can opener of claim 8 wherein said finishing notch is on a forward edge of said channel.

10. The can opener of claim 8 wherein said finishing notch is on a rear edge of said channel.

11. The can opener of claim 8 including a retainer slot extending generally rearwardly from said channel.

12. The can opener of claim 8 wherein said channel is generally J-shaped or generally in the form of an inverted J.

13. The can opener of claim 1 including a horizontally-cutting or vertically-cutting can opener on said body.

14. A can opener for a pull top-type can, the opener comprising:

a body comprising a front surface, a rear surface, and a bottom surface, said body defining a heel; said heel having a curved edge comprising at least a curved front surface, said bottom surface, and at least a portion of said rear surface; said curved front surface and said bottom surface of said heel defining a continuously curving edge with a smooth transition between said front and bottom surfaces;

a tab engaging lip having a flat surface extending rearwardly from an upper, forward end of said heel front surface, said lip flat surface being angled relative to said forward end of said heel front surface to form an acute angle therewith such that an imaginary line extending from, and collinear with, said lip flat surface intersects a back of said heel along said body rear surface; and a starting notch at an end of said flat surface opposite said intersection between said flat surface and said heel, said starting notch having a forward edge intersecting with said flat surface and extending toward said heel;

a generally upwardly facing finishing notch; said finishing notch being spaced above said starting notch and being positioned forward of said bottom surface; and a movable retainer selectively movable between a closed position in which said finishing notch is closed to maintain a can lid on said opener after said can lid has been removed from a can and an open position in which said finishing notch is opened to allow a tab to be placed on said finishing notch or removed from said finishing notch.

15. The can opener of claim 14 wherein said movable retainer comprises an arm pivotally mounted to said body above said finishing notch; said arm having a downwardly extending finger; said arm being movable between a first position in which said finger engages a front edge of said finishing notch to close said finishing notch and a second position in which said finger is spaced above said finishing notch front edge to open said finishing notch.

16. The can opener of claim 15 wherein said arm is spring biased to its first position.

17. The can opener of claim 14 including an opening into said finishing notch; said retainer being movable between said closed position in which said finishing notch opening is closed and said open position in which said finishing notch opening is opened.

18. The can opener of claim 17 wherein said retainer comprises an axially slidable rod which is at least partially received in an upper portion of said opener body, said rod being slidable in a direction transverse to an axis of said finishing notch opening, whereby, when in said open position, said retainer rod traverses said finishing notch opening to close said finishing notch opening, and when in said open position, said rod is substantially drawn into said body to open said finishing notch opening.

19. The can opener of claim 17 wherein said retainer comprises a retainer body pivotal relative to said body, said retainer body comprising a forward edge adapted to engage a surface of said finishing notch opening; said retainer body being movable between said closed position in which said retainer body forward edge engages said finishing notch opening surface and said open position in which said retainer body forward edge is spaced from said finishing notch opening surface.

20. The can opener of claim 19 wherein said retainer body forward edge is shaped, such that, when said retainer body is in said closed position, said retainer body forward edge defines an angle with said finishing notch opening surface such that said retainer body will be moved away from said finishing notch opening surface by the action of passing a can lid tab into said port.

21. The can opener of claim 19 including an actuator; said actuator being in the form of a push-pull button on an upper surface of said opener or a finger engagable trigger positioned centrally of said opener body.

22. The can opener of claim 14 wherein said retainer is biased to said closed position.

23. The can opener of claim 17 wherein said retainer comprises a member pivotal in a plane generally perpendicular to the plane of the opener body; the retainer comprising a leg portion sized to extend across said finishing notch opening.

24. The can opener of claim 14 comprising a first handle fixed to and extending rearwardly from said body and a second movable handle pivotal relative to said body and said first handle; said movable handle having a gripping end and a forward end; said movable handle being pivotally connected to one of said body and first handle intermediate said movable handle gripping end and forward end; said finishing notch being positioned on one of said opener body and said movable handle forward end and said retainer being positioned on the other of said opener body and said movable handle forward end; said opener comprising a finishing notch lip proximate said finishing notch and said retainer comprising a retainer lip; said movable handle being pivotal between a first position in which said retainer lip is proximate said finishing notch lip to place said retainer in said closed position and a second position in which said retainer lip is spaced from said finishing notch lip to place said retainer in said open position.

25. The opener of claim 24 wherein said movable handle pivots in a plane generally parallel to the plane of said opener body.

26. The opener of claim 24 wherein said movable handle pivots in a plane generally perpendicular to the plane of said opener body.

27. The opener of claim 14 including a horizontally-cutting or vertically-cutting can opener on said body.

28. A can opener for a pull top-type can, the opener comprising:

a body defining a heel; said heel having a front edge, a bottom edge, and a back edge; at least said front edge and said bottom edge defining a continuously curving edge;

a tab engaging lip having a flat surface extending rearwardly from an upper, forward end of said heel front edge; said lip flat surface forming an acute intersection with said heel front edge; said lip flat surface being angled relative to said forward end of said heel front edge such that an imaginary line extending from and collinear with said lip flat surface intersects a back of said heel at said back edge of said body;

a starting notch along said lip flat surface spaced inwardly from said heel front edge, said starting notch having a forward edge intersecting with said flat surface and extending toward said heel; said starting notch is below said lip flat surface and forward of said body bottom edge;

a generally upwardly facing finishing notch spaced above said starting notch and being positioned forward of said body bottom edge; said finishing notch being accessible from a position above said finishing notch; and a movable retainer proximate said finishing notch; said retainer being movable between a first position in which said finishing notch is substantially closed and a second position in which said finishing notch is substantially opened.

29. The can opener of claim 28 wherein said starting notch and finishing notch are both positioned on said body.

30. The can opener of claim 28 including a first port in communication with said starting notch and a second port in communication with said finishing notch; said first port extending from a front surface of said body to said starting notch; said second port extending from one of said front surface or an upper surface of said body.

31. The can opener of claim 28 including a port extending from said forward edge of said opener body to said starting notch and a channel extending from said starting notch to said finishing notch.

32. The can opener of claim 28 wherein said retainer is defined at least in part by a lip; said lip defining at least a part of a channel extending from said forward edge of said opener body to said finishing notch.

33. The can opener of claim 28 comprising a first handle fixed to and extending rearwardly from said body and a second movable handle pivotal relative to said body and said first handle; said movable handle having a gripping end and a forward end; said movable handle being pivotally connected to said one of said body and first handle intermediate said movable handle gripping end and forward end; said finishing notch being positioned on one of said opener body and said movable handle forward end and said retainer being positioned on the other of said opener body and said movable handle forward end; said opener comprising a finishing notch lip proximate said finishing notch and said retainer comprising a retainer lip; said movable handle being pivotal between a first position in which said retainer lip is proximate said finishing notch lip to place said retainer in said closed position and a second position in which said retainer lip is spaced from said finishing notch lip to place said retainer in said open position.

34. A can opener for a pull top-type can, the opener comprising:

a substantially planar body having a front surface, a rear surface, and a bottom surface, said body defining a heel; said heel comprising a front edge, a bottom edge and rear edge; at least said heel front edge and bottom edge defining a continuously curved edge; said body having a vertical axis extending through said bottom edge;

a first handle fixed to and extending rearwardly from said body; said handle being generally perpendicular to said vertical axis;

a second movable handle pivotal relative to said body and said first handle; said movable handle having a gripping end and a forward end; said second handle being pivotally connected to one of said body and said first handle intermediate said second handle gripping end and forward end;

a tab engaging lip having a flat surface extending rearwardly from an upper, forward end of said heel front surface; said lip flat surface forming an acute intersection with said heel front surface; said lip flat surface being angled relative to said forward end of said heel front surface such that an imaginary line extending from and collinear with said lip flat surface intersects a back of said heel at said rear surface of said body;

a starting notch in said flat lip surface and spaced inwardly from said front edge of said heel, said starting notch having a forward edge intersecting with said flat surface and extending toward said heel;

a generally upwardly facing finishing notch spaced vertically, with respect to said vertical axis, above said starting notch and a finishing notch lip proximate said finishing notch; said finishing notch being positioned forward of said body bottom surface and being accessible from a position above said finishing notch; and a retainer proximate said finishing notch; said retainer comprising a retainer lip;

said finishing notch being positioned on one of said opener body and said second handle forward end and said retainer being positioned on the other of said opener body and said second handle forward end;

whereby, said second handle is pivotal between a first position in which said retainer lip is proximate said finishing notch lip to place said retainer in said closed position and a second position in which said retainer lip is spaced from said finishing notch lip to place said retainer in said open position.

35. The can opener of claim 34 including a horizontally cutting or vertically cutting can-opener assembly secured to said can opener at a forward end thereof.

* * * * *